US011313122B2

(12) United States Patent
Budd

(10) Patent No.: US 11,313,122 B2
(45) Date of Patent: Apr. 26, 2022

(54) UNITIZED CURTAINWALL SYSTEMS AND METHODS

(71) Applicant: New Hudson Facades, LLC, New York, NY (US)

(72) Inventor: Michael Budd, Devon, PA (US)

(73) Assignee: NEW HUDSON FACADES, LLC, New York, NY (US)

( * ) Notice: Subject to any disclaimer, the term of this patent is extended or adjusted under 35 U.S.C. 154(b) by 0 days.

(21) Appl. No.: 16/909,033

(22) Filed: Jun. 23, 2020

(65) Prior Publication Data

US 2021/0032860 A1 Feb. 4, 2021

Related U.S. Application Data

(63) Continuation of application No. 16/018,520, filed on Jun. 26, 2018, now abandoned.

(60) Provisional application No. 62/608,376, filed on Dec. 20, 2017, provisional application No. 62/527,694, filed on Jun. 30, 2017.

(51) Int. Cl.

| | |
|---|---|
| ***E04B 7/14*** | (2006.01) |
| ***E04B 2/96*** | (2006.01) |
| ***E04B 1/68*** | (2006.01) |

(52) U.S. Cl.

CPC ..... *E04B 2/965* (2013.01); *E04B 1/6806* (2013.01); *E04B 2103/06* (2013.01)

(58) Field of Classification Search

CPC . E06B 7/14; E06B 3/5427; E06B 2/90; E06B 2/96; E06B 2/965; E06B 2/967

See application file for complete search history.

(56) References Cited

U.S. PATENT DOCUMENTS

| | | | |
|---|---|---|---|
| 3,436,887 | A | 4/1969 | Grossman |
| 3,841,045 | A | 10/1974 | Criswell |
| 4,685,263 | A | 8/1987 | Ting |
| 4,765,107 | A | 8/1988 | Ting |
| 4,819,405 | A | 4/1989 | Jackson |
| 5,065,557 | A | 11/1991 | Laplante et al. |

(Continued)

OTHER PUBLICATIONS

"U.S. Appl. No. 16/018,520, Non Final Office Action dated Sep. 16, 2019", 9 pgs.

(Continued)

*Primary Examiner* — Babajide A Demuren
*Assistant Examiner* — Daniel J Kenny
(74) *Attorney, Agent, or Firm* — Schwegman Lundberg & Woessner, P.A.

(57) ABSTRACT

This document discusses, among other things, unitized curtain systems and methods related to the fabrication and installation of curtainwalls. A curtainwall unit may comprises a frame including a horizontal gutter, a horizontal sill, a first vertical mullion between a first end of the horizontal gutter and a second end of the horizontal sill, and a second vertical mullion between a second end of the horizontal gutter and a second end of the horizontal sill. The horizontal gutter may include a rear channel extending across the horizontal gutter, and at least one protected horizontal channel at least partially beneath the rear channel, the rear channel having at least one opening to the at least one horizontal gutter. Each vertical mullion may include a protected vertical chamber having an opening to the at least one protected horizontal channel.

30 Claims, 34 Drawing Sheets

(56) References Cited

U.S. PATENT DOCUMENTS

| | | | | |
|---|---|---|---|---|
| 5,123,212 | A | 6/1992 | Dallaire et al. | |
| 5,253,459 | A | 10/1993 | Parinas et al. | |
| 5,369,924 | A | 12/1994 | Neudorf | |
| 5,452,552 | A | 9/1995 | Ting | |
| 5,596,851 | A | 1/1997 | Ting | |
| 5,687,524 | A | 11/1997 | Ting | |
| 5,839,236 | A | 11/1998 | Frey | |
| 6,158,182 | A | 12/2000 | Biebuyck | |
| 6,357,186 | B1 | 3/2002 | Gould | |
| 6,393,778 | B1 | 5/2002 | Ting | |
| 6,598,361 | B2 | 7/2003 | Ting | |
| 6,722,089 | B2 | 4/2004 | Budzinski | |
| 6,804,920 | B2 | 10/2004 | Hogan | |
| 6,993,873 | B2 | 2/2006 | Biebuyck et al. | |
| 7,562,509 | B2 | 7/2009 | Ness | |
| 7,631,471 | B2 | 12/2009 | Grunewald et al. | |
| 7,644,549 | B2 | 1/2010 | Speck | |
| 7,818,934 | B2 | 10/2010 | Hall et al. | |
| 7,827,746 | B2 | 11/2010 | Speck | |
| 7,987,644 | B2 | 8/2011 | Walker, III et al. | |
| 8,191,325 | B2 | 6/2012 | Ting | |
| 8,353,138 | B2 * | 1/2013 | Sigmund | E06B 7/14 52/209 |
| 8,615,938 | B2 | 12/2013 | Arbour | |
| 9,062,490 | B2 * | 6/2015 | Kadavy | E06B 3/4415 |
| 9,212,481 | B2 | 12/2015 | Stramandinoli | |
| 9,464,432 | B2 | 10/2016 | Lang et al. | |
| 9,874,018 | B1 | 1/2018 | Conklin | |
| 10,077,598 | B2 * | 9/2018 | Albrecht | E06B 3/303 |
| 10,087,678 | B2 * | 10/2018 | Pettibone | E06B 7/14 |
| 10,329,758 | B2 | 6/2019 | Margalit | |
| 2003/0221381 | A1 | 12/2003 | Ting | |
| 2006/0070342 | A1 | 4/2006 | Ferro | |
| 2006/0201084 | A1 | 9/2006 | Arias | |
| 2008/0168724 | A1 | 7/2008 | Spannbauer et al. | |
| 2015/0027072 | A1 | 1/2015 | Ting | |
| 2015/0107173 | A1 | 4/2015 | Ku et al. | |
| 2015/0308109 | A1 | 10/2015 | Yang et al. | |
| 2016/0069073 | A1 | 3/2016 | Gris et al. | |
| 2017/0234007 | A1 | 8/2017 | Ting | |
| 2018/0274232 | A1 | 9/2018 | Levin | |
| 2018/0305921 | A1 | 10/2018 | Margalit | |
| 2019/0060688 | A1 | 2/2019 | Kim et al. | |
| 2019/0063064 | A1 | 2/2019 | Paetow et al. | |
| 2019/0136523 | A1 | 5/2019 | Claeys | |
| 2019/0284798 | A1 | 9/2019 | Klein et al. | |
| 2019/0330855 | A1 | 10/2019 | Liu | |
| 2020/0032509 | A1 | 1/2020 | Claeys et al. | |
| 2020/0032510 | A1 | 1/2020 | Claeys et al. | |

OTHER PUBLICATIONS

"U.S. Appl. No. 16/018,520, Notice of Allowance dated Mar. 24, 2020", 7 pgs.

"U.S. Appl. No. 16/018,520, Notice of Allowance dated Nov. 27, 2019", 6 pgs.

"U.S. Appl. No. 16/018,520, Response Filed Oct. 28, 2019 to Non Final Office Action dated Sep. 16, 2019", 12 pgs.

U.S. Appl. No. 16/018,520, filed Jun. 26, 2018, Unitized Curtainwall Systems and Methods.

* cited by examiner

UNITIZED CURTAINWALL SYSTEMS AND METHODS

CROSS-REFERENCE TO RELATED APPLICATION

This patent application is a continuation of U.S. patent application Ser. No. 16/018,520, filed Jun. 26, 2018, which application claims the benefit of U.S. Provisional Patent Application No. 62/608,376, filed Dec. 20, 2017, entitled "UNITIZED CURTAINWALL SYSTEMS AND METHODS", and also claims the benefit of U.S. Provisional Patent Application No. 62/527,694, filed Jun. 30, 2017, entitled "UNITIZED CURTAINWALL SYSTEMS AND METHODS" which are incorporated by reference herein in their entirety.

TECHNICAL FIELD

This document relates generally to building construction, and more particularly, but not by way of limitation, to unitized curtainwall systems and methods of installation and fabrication.

BACKGROUND

Unitized curtainwall is an exterior cladding product for buildings that is prefabricated and preassembled prior to shipment to the project site. Advantages of preassembly may include improved quality as the product may be preassembled in a clean and dry environment, reduced costs as the cost of factory labor is usually significantly less than field labor, and improved scheduling as the curtainwall product can be preassembled before installation resulting in reduced on-site installation time.

Unitized curtainwall systems typically have two or more lines of gasketry to form pressure equalized cavities within the framing members of the unitized system. The first line of gaskets create a "rain screen", which prohibits the majority of rain water from entering the system. The first line of gaskets are intentionally designed with "gaps" to allow for water drainage to the exterior of the building. These gaps also allow for the pressure within the framing system to be equal to the pressure at the exterior of the building which avoids a negative pressure draw of moisture at this line to the interior of the building. Some unitized systems may include three lines of gasketry.

SUMMARY

This document discusses, among other things, a unitized curtainwall system with improved venting and drainage, improved gasket seals that do not require wet seals at joints between units along the horizontal gutters of the units and at corners where multiple curtainwall units form joints, and improved shadowbox assemblies.

This summary is intended to provide an overview of subject matter of the present patent application. It is not intended to provide an exclusive or exhaustive explanation of the disclosure. The detailed description is included to provide further information about the present patent application. Other aspects of the disclosure will be apparent to persons skilled in the art upon reading and understanding the following detailed description and viewing the drawings that form a part thereof, each of which are not to be taken in a limiting sense.

BRIEF DESCRIPTION OF THE DRAWINGS

In the drawings, which are not necessarily drawn to scale, like numerals may describe similar components in different views. Like numerals having different letter suffixes may represent different instances of similar components. The drawings illustrate generally, by way of example, but not by way of limitation, various embodiments discussed in the present document.

FIGS. 10A, 10B, 10C-1 and 10C-2, and 10D-1 and 10D-2 illustrate views of an embodiment of the curtainwall system respectively taken along view lines H1-H1, H2-H2, V1-V1 and V2-V2 of FIG. 5H.

DETAILED DESCRIPTION

Figure 1:
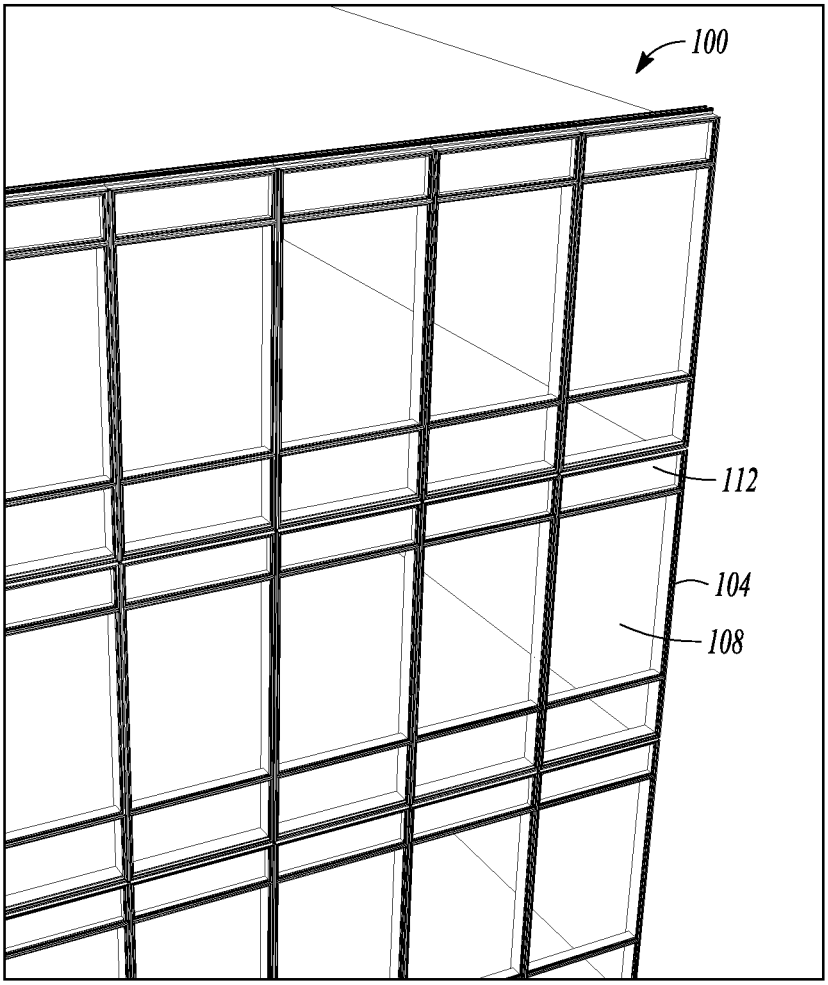
FIG. 1 illustrates an example of a curtainwall system.
Figure 2A:
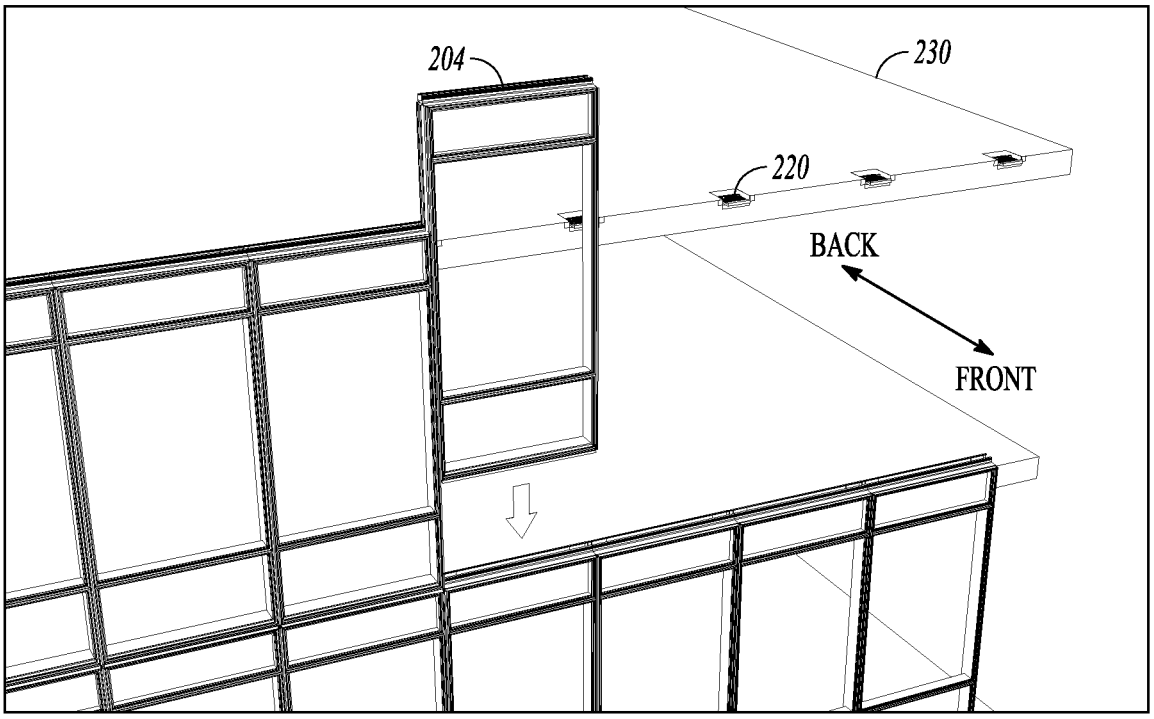
FIGS. 2A-2D illustrate an example of a curtainwall installation sequence.
Figure 2B:
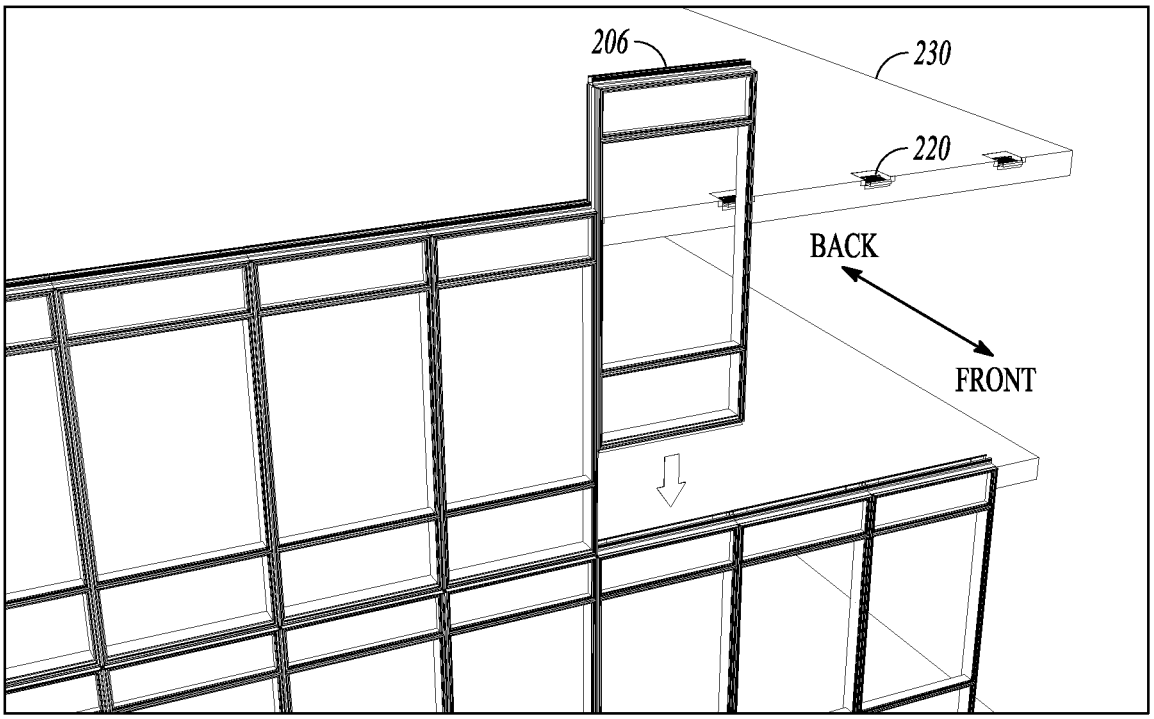
Figure 2C:
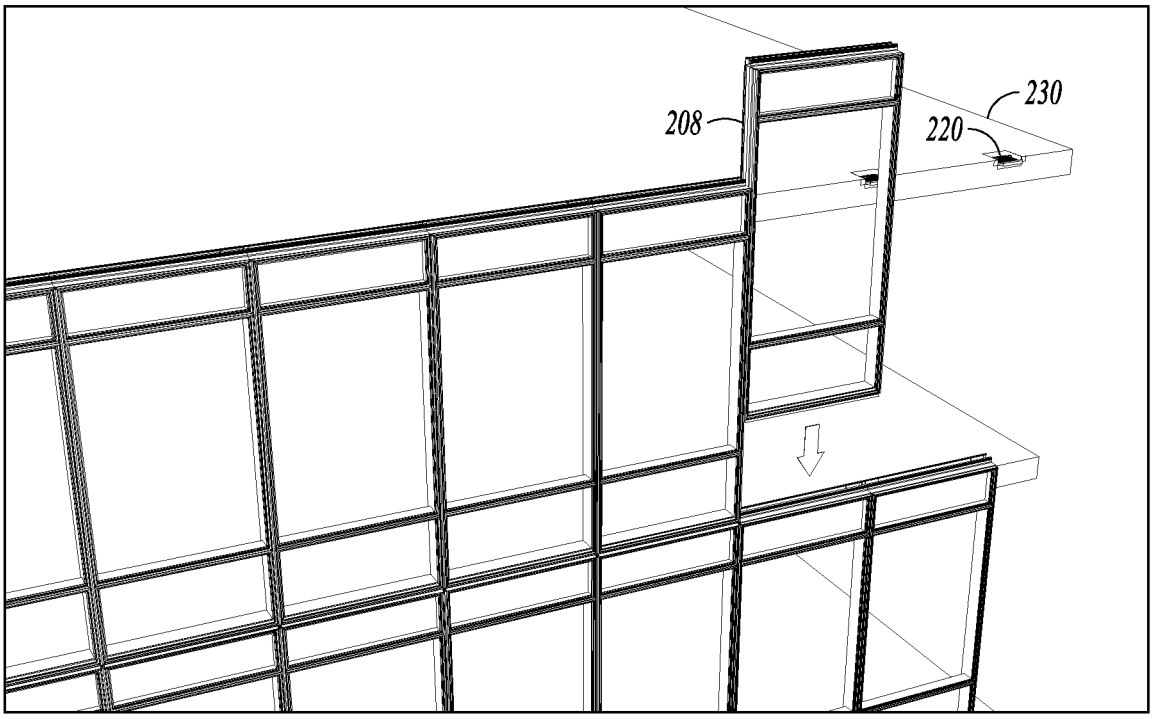
Figure 2D:
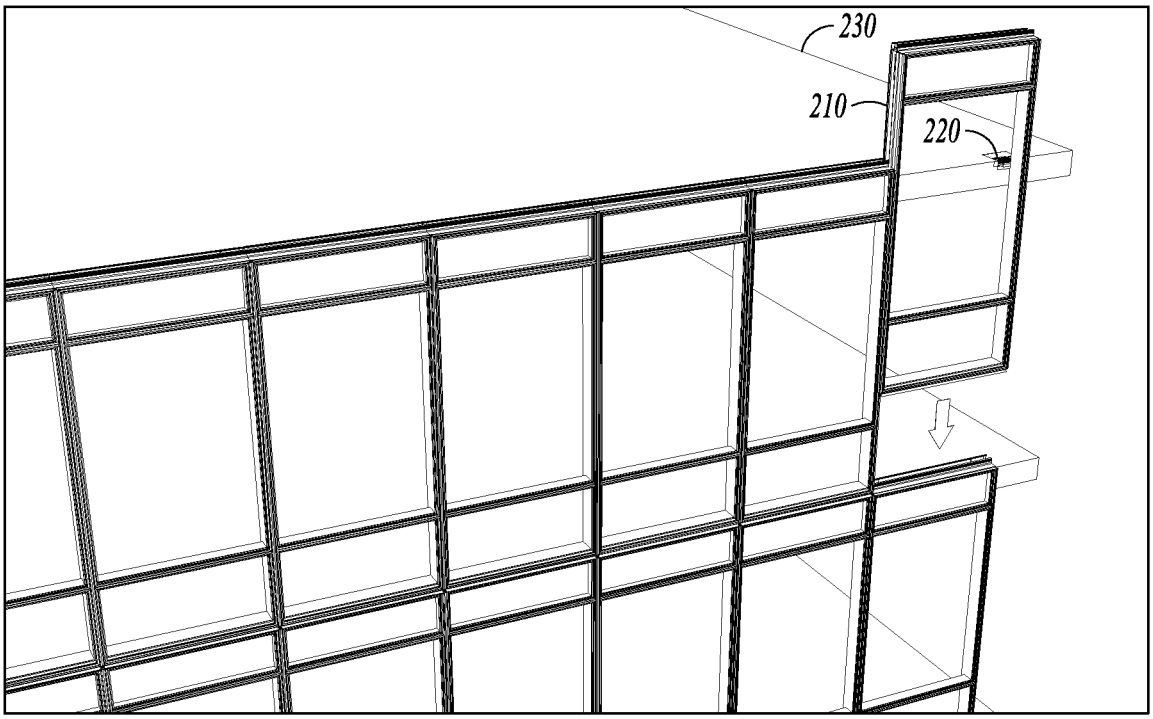
Figure 3A:
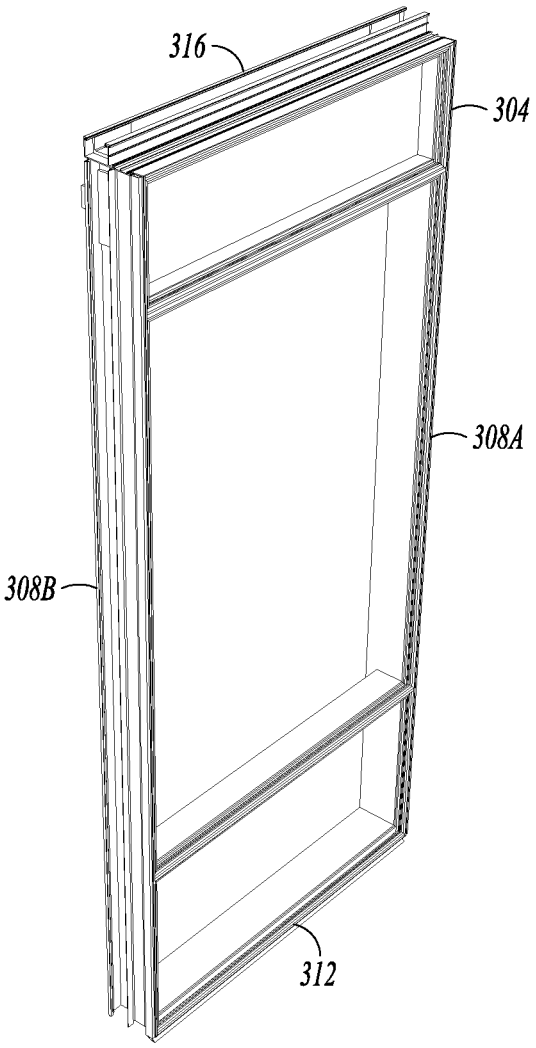
FIGS. 3A-3D illustrate perspective views of an example of a curtainwall unit used during the installation sequence illustrated in FIGS. 2A-2D.
Figure 3B:
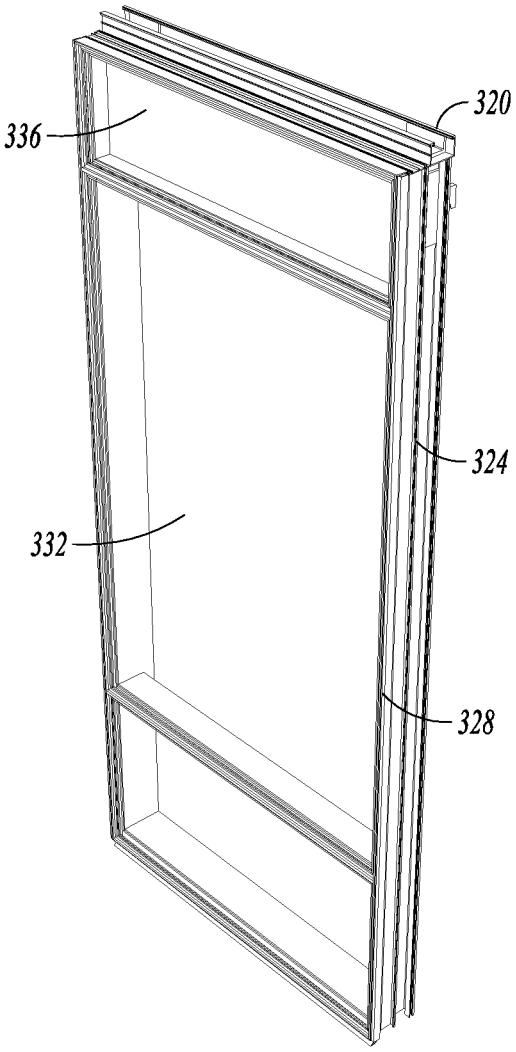
Figure 3C:
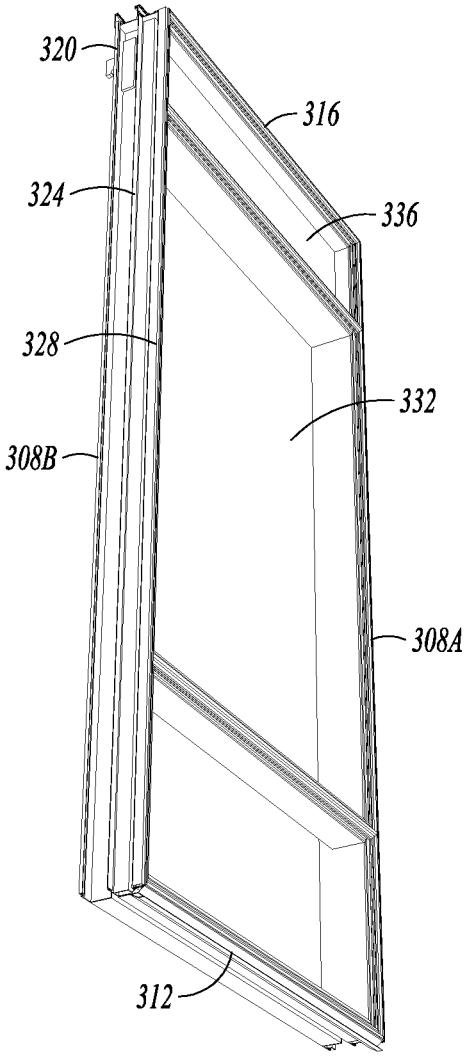
Figure 3D:
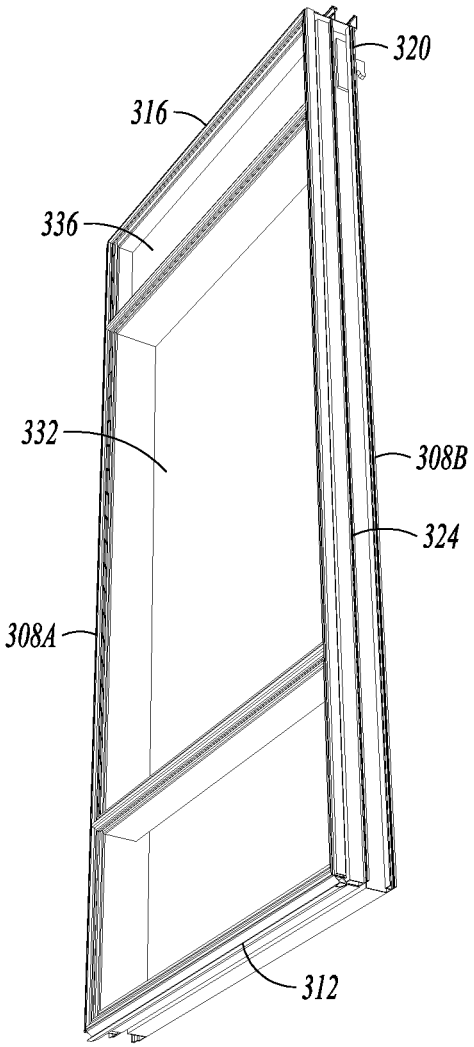

Various embodiments of pre-fabricated curtainwall units may be configured such that they form two internal framing chambers with three lines of gaskets when they are joined together. Various embodiments of the present subject matter provide a curtainwall system with any one or any combination of more than one of the following features: on-site installation that reduces or eliminates the use of wet sealants, improved venting and water drainage, and improved shadowbox assemblies. An overview of some of these improved features is provided below, followed by a more detailed description of these features with reference to the drawings.

The perimeter framing members of a unitized system may be designed with gaskets and male/female mating aluminum extrusions which, when fitted together, create an air and water barrier between the interior and exterior without the use of wet sealants between adjacent curtainwall units. However, wet sealants have still been conventionally applied on-site at the corners where multiple curtainwall units join together. Various embodiments of the curtain wall system reduce or eliminate the use of wet sealants during the on-site installation of the curtainwall units. By avoiding the use of wet sealants during on-site installation, various embodiments of the present subject provide advantages such as reduced on-site installation time, higher quality control as the gaskets/extrusions used by the present subject matter may be more tolerant of more diverse on-site conditions such as dirt and moisture than wet sealant, and reduced weather-related delays as the curtainwall units may be installed during weather conditions such as cold, rain and extreme heat that would not be appropriate for applications of wet sealants. Rather than using wet sealant, a silicone sponge gasket may be placed at the "splice" between mating units of the curtainwall system and secured in place using a spring compression clip. The spring compression clip may be an aluminum extrusion designed to elastically deform and snap into the mating gutter extrusion, thereby compressing the silicone sponge gasket using an appropriate amount of pressure to create a weathertight "seal" between adjacent units of the curtainwall system. When installing the units of a curtainwall system, two units may be horizontally adjacent to each other, and two other units may be stacked on top of the first two units. Where the units have a rectangular profile with both horizontal and vertical peripheral edges, the units cooperate to provide gasketed lines along both the horizontal and peripheral edges. However, a corner gap may be created at the backside of the system where the horizontal and peripheral edges of the four units come together. Rather than using a wet sealant to seal this corner gap, a silicone putty plug may be placed in this corner gap to maintain an air seal at the air seal gasket line. The putty plug may be compressible under pressure, but has a shape memory. Thus, the plug may be temporally compressed within the fingers. For example, the plug may be rolled between the fingers to reduce the diameter of the plug. The compressed plug may then be inserted into the hole where it expands to plug the hole and maintain an air seal at the air seal gasket line of the system. The putty may be made from a pliable material which can create an effective air seal while allowing for the required movements (live load slab deflection, thermal, seismic, etc.).

Various embodiments of the present subject matter improve venting and drainage using a ventilated chamber (referred to herein as a protected vertical chamber) within a vertical framing member ("vertical mullion") and using a horizontal chamber (referred to herein as a protected horizontal chamber) that provides a communication channel for air and water between a rear chamber of the horizontal gutter the protected vertical chamber.

A first line of gaskets along the periphery of the units near the exterior of the installed system enables the installed system to weep water from interior cavities out to the exterior of the building, and also enables pressure equalization of the interior cavities of the system. A second, or, middle line of gaskets creates a watertight joint. A third line of gaskets along the periphery of the units near the interior of the installed system provides an air seal on the building side of the installed curtainwall system. These three lines of gaskets provide three separate lines of defense to water intrusion, including two water tight lines of defense. A combination of the protected horizontal chamber in the horizontal gutter extrusion and the protected vertical chamber in a forward chamber of a vertical mullion provide a communication path for water to weep from behind the second or middle line of gaskets to the exterior of the building. This communication path also functions as ventilation/pressure equalization path to the interior chamber without providing a path for exterior water to enter the interior chamber as a pressure draw (head height) equal to the building floor height would be needed to allow exterior water to rise up through the protected vertical chamber, into the protected horizontal chamber, and into the interior chamber of the installed system. Since the interior and exterior chambers have generally equal pressures because of the ventilation pathway through the protected horizontal and vertical chambers, it is extremely unlikely that a transient pressure gradient will provide enough pressure to draw water through this pathway up to the next floor in the building.

As will be discussed in more detail below with respect to FIGS. 11A-11D and 12A-12D, various embodiments of the unitized curtainwall system may provide improved preassembled shadowbox assemblies. Shadowbox assemblies may be used at locations where there is a desire to create an opaque area within the curtainwall, such as at the floor slab, where there is a desire to "hide" the floor slab and perimeter structure as well as other buildings elements (mechanical system, electrical system, etc.) above the ceiling line. A shadowbox is typically made-up of the same glass type as the vision area in an effort to blend the opaque/spandrel area, which may be used to hide the floor slab, with the vision area. The same insulated glass unit that is being used at the vision area may also be used at the opaque area. Some features of the present subject matter that allow the shadowbox to create an opaque area within the curtainwall while blending with the vision area may include: an insulated glass unit that mimics the glass in the vision areas, a painted metal panel (e.g. aluminum panel) behind the glass to provide visual "depth" in an effort to aesthetically mimic the vision areas. Additionally, insulation behind the painted metal panel may be used to meet energy code requirements, a metal backpan at the interior side of the curtainwall system may be used to provide the air, vapor, and water barrier between exterior and interior, and a mechanical attachment between the metal backpan and the shadowbox sub-assembly frame may be used for fire containment. In some systems, another metal panel may be placed behind the insulation to create an air, water, and vapor barrier between the exterior and interior. Depending on the manufacturer and the geographic area of use, the cavity created between the glass and the metal panel may be unvented, may be vented to the exterior, or may be vented to the interior. The air within the cavity may undergo extreme temperature changes because of the enclosed or partially enclosed (enclosed but vented) cavity of the shadowbox. In cold U.S. climates, the air cavity temperature may drop to below 0 F during cold months. Conversely, during warm months with high sun angles, the temperature within the cavity can reach in excess of 200 F. At elevated temperatures, thermal stress can lead to glass breakage. Sealants and gaskets within the shadowbox assembly can also be negatively impacted by extreme elevated temperatures. Some desirable features of the shadowbox include: mechanical retention of the shadowbox assembly without rigidly constraining the shadowbox assembly edges; a protected ventilation/weep system that minimizes the water intrusion into the shadowbox cavity (ventilation and drainage occur in protected vertical chamber); and a preassembled shadowbox assembly that allows for ease of installation during the curtainwall assembly process.

As the vented shadowbox cavities still may undergo extreme temperature changes that may cause the aluminum metal panel behind the glass to expand and contract with the changes, various embodiments may use connections between the primary framing members of the unitized curtainwall system and the shadowbox assembly to allow the aluminum panel to freely expand and contract with the temperature fluctuations.

A challenge with venting the shadowbox cavity is water/vapor accumulation within the cavity. Excessive condensation may leave dirt and stains on the inside face of glass, and the condensation itself can be unsightly. It may be desirable to minimize the ability of exterior water to get to the vent holes when the cavity is vented to the exterior, and to drain any incidental water and/or condensate from the cavity through weep holes.

Various embodiments of the shadowbox assembly of the present subject matter may include ventilation and weep holes to properly vent and drain the shadowbox assembly, which uses a protected ventilation/weep system that minimizes the water intrusion into the shadowbox cavity (ventilation and drainage occur in protected vertical chamber).

Additionally, the shadowbox assembly of the present subject matter may be a preassembled shadowbox assembly that allows for ease of installation during the curtainwall assembly process. As components of the shadowbox assembly may expand and contract with temperature fluctuations, various embodiments mechanically retain the shadowbox assembly within the curtainwall unit without rigidly constraining the shadowbox assembly edges. For example, at the horizontal edges between the shadowbox assembly frame and the curtainwall unit, the base horizontal extrusion may be designed with a reveal and the shadowbox frame may be designed with a lip to handle the inward load of the shadow box, and a gasket between the glass and the shadowbox frame may handle the outward load of the shadowbox assembly. Along the vertical edges between the shadowbox assembly frame and the vertical frame of the curtainwall unit, an aluminum channel may be fastened to the primary vertical framing members or other structural components may be incorporated to restrict movement of the shadowbox assembly perpendicular to the glass plane, but still allow floating to accommodate expansion and contraction of the aluminum panel. By way of example and not limitation, other structural components that accommodate expansion and contraction may include a Tinnerman clip, and a pin punched through the galvanized sheet metal into the Tinnerman clip. The pin and Tinnerman clip generally hold the shadowbox assembly in position, but allow some movement.

Various embodiments of the unitized curtainwall system may provide any one or any combination of more than one of these beneficial features. For example, various curtainwall system embodiments may include any one or any combination of some or all of the following: a gasket logic that creates two "watertight" lines of defense within the system, a path between the exterior and interior chambers which is protected and requires a pressure draw (head height) equal to the building floor height, a gasketed system (e.g. silicone plug) at the back chamber of the four way intersection that does not require the use of wet sealant, a silicone sponge gasket that is placed at the "splice" along the top of two adjacent curtainwall units and set using spring compression clips, and a preassembled shadowbox assembly retained by the exterior glazing. Those of ordinary skill in the art, upon reading and comprehending this disclosure, will understand that unitized curtainwall projects may be customized using new extrusions to accommodate specific requirements (floor heights, wind pressures, architectural aesthetics, etc.) for each project while still incorporating one or more of these beneficial features. These features are discussed in more detail, with reference to the figures, below.

FIG. 1 illustrates an example of a curtainwall system 100. The curtainwall system 100 may include a plurality of prefabricated curtainwall units 104 that can be quickly installed to provide a building with exterior cladding. Each of the prefabricated curtainwall units 104 may include a vision area 108 and a shadowbox 112. The vision area 108 may provide visual access through the curtainwall. From the exterior of the building with an installed curtainwall system, the shadowbox 112 may appear visually similar to the vision area 108 without providing visual access through the curtain wall units to the floor slab or other parts of the structure. For example, curtainwall units 104 may be formed in rows and columns to form an array of curtainwall units. Thus, a given curtainwall unit may have other units immediately adjacent in a horizontal direction and in a vertical direction.

FIGS. 2A-2D illustrate an example of a curtainwall installation sequence. The curtainwall units 204, 206, 208, and 210 may be slid in place next to each other, and provide a sealing fit with each other. Each unit has a main frame that may be formed from extruded aluminum. The vertical frame members may be referred to as vertical mullions, the bottom horizontal frame member may be referred to as a sill, and the top horizontal frame member may be referred to as a gutter. The perimeter framing members of a unitized curtainwall system may be designed with gaskets and male/female mating aluminum extrusions which, when fitted together, create an air and water barrier between the interior and exterior without the use of wet sealants between adjacent curtainwall units. A rain screen gasket may be between the units toward the front of the curtainwall system. Also, the sealing fit between curtain wall units includes an air seal gasket line toward the back of the curtainwall system, and a water barrier gasket line between the rain screen gasket and the air barrier gasket line. The curtainwall units may be attached to the building structure 230 using brackets such as the brackets 220 illustrated in FIGS. 2A-2D.

FIGS. 3A-3D illustrate perspective views of an example of a curtainwall unit 304 used during the installation sequence illustrated in FIGS. 2A-2D. The curtainwall unit 304 may include vertical mullions 308*a* and 308*b*, sill 312, and gutter 316. The curtainwall unit may also include gaskets used to form an air seal 320, a water seal 324, and a rainscreen 328. The water seal 324 and the air seal 320 may be water tight. The rainscreen may not be water tight. The curtain wall unit may also include a vision area 332, and a shadowbox 336. The gutter 316 may facilitate the drainage of fluid from an area between the air seal 320 and water seal 324 to the exterior in front of the installed curtainwall system. The air seal 320 may extend along a perimeter of the curtainwall unit 304 and may form an air seal gasket line. Putty, such as a silicone putty plug may be used to supplement the air seal 320, such as where gaps exist between adjacent curtainwall units 304. The water seal 324 may extend along a perimeter of the curtainwall unit 304 and may form a water seal gasket line. The water seal 324 may provide a watertight joint. The rainscreen 328 may extend along a perimeter of the curtainwall unit 304 and may form a rainscreen gasket line. The rainscreen may be designed with gaps in the rainscreen gasket line to allow water to weep out to the exterior, and to allow pressure equalization of interior cavities of the curtainwall system 100. In an installed system, adjacent units may form a front cavity between the rainscreen 328 and the water seal 324 and a rear cavity between the water seal 324 and the air seal 320. FIGS.

Figure 4A:
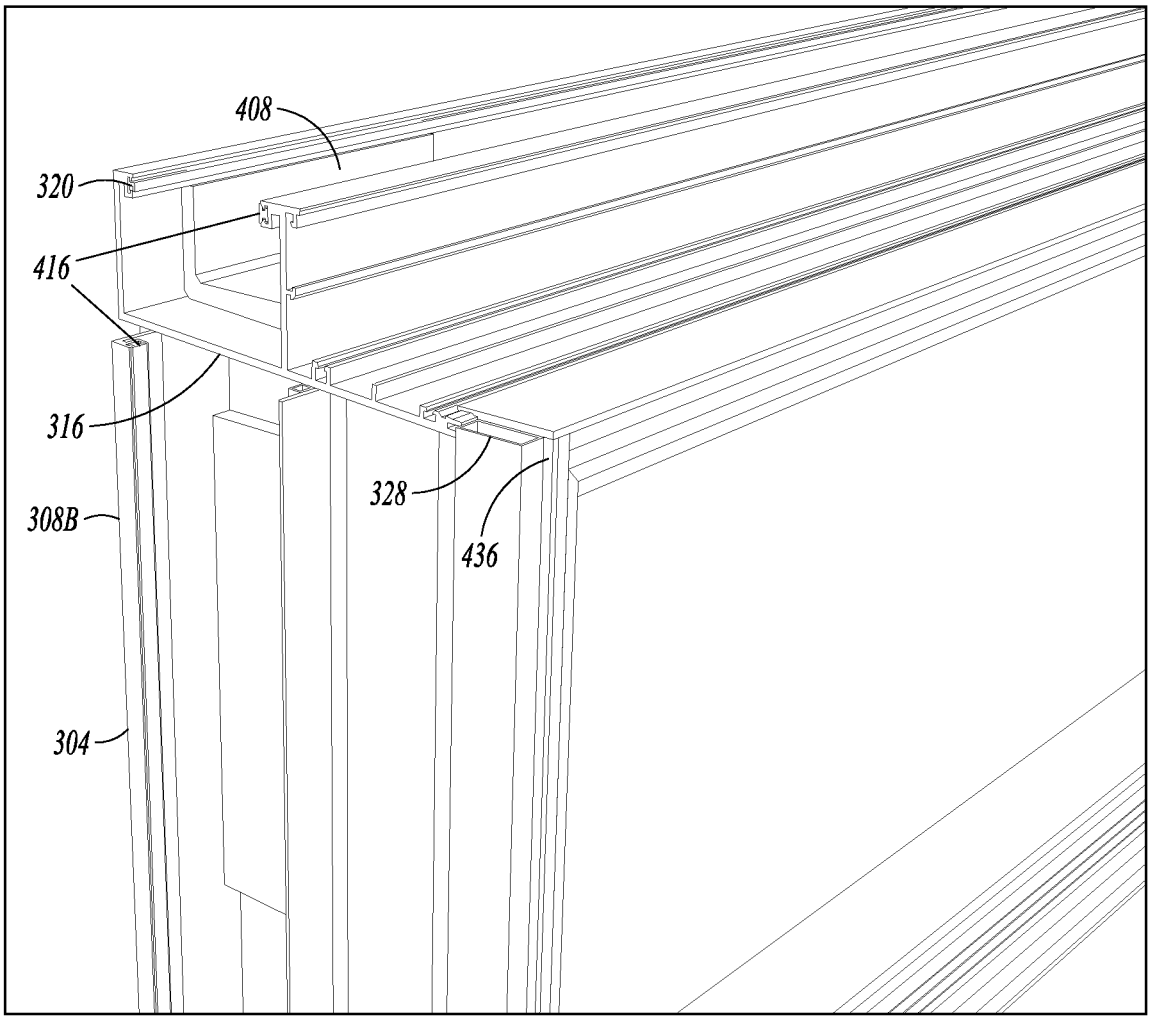
FIGS. 4A-4D illustrate closer views of the periphery of the curtainwall unit illustrated in FIGS. 3A-3D.
Figure 4B:
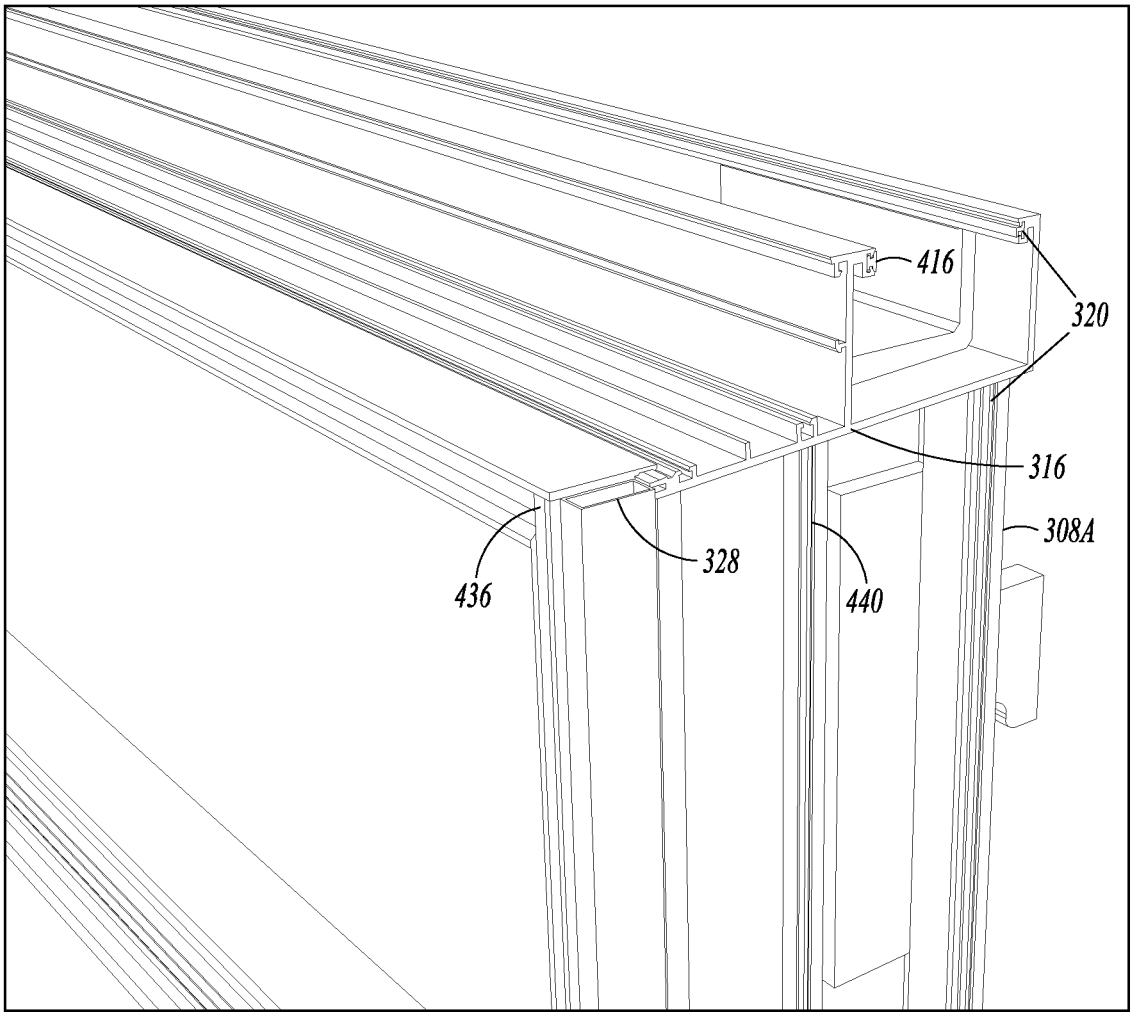
Figure 4C:
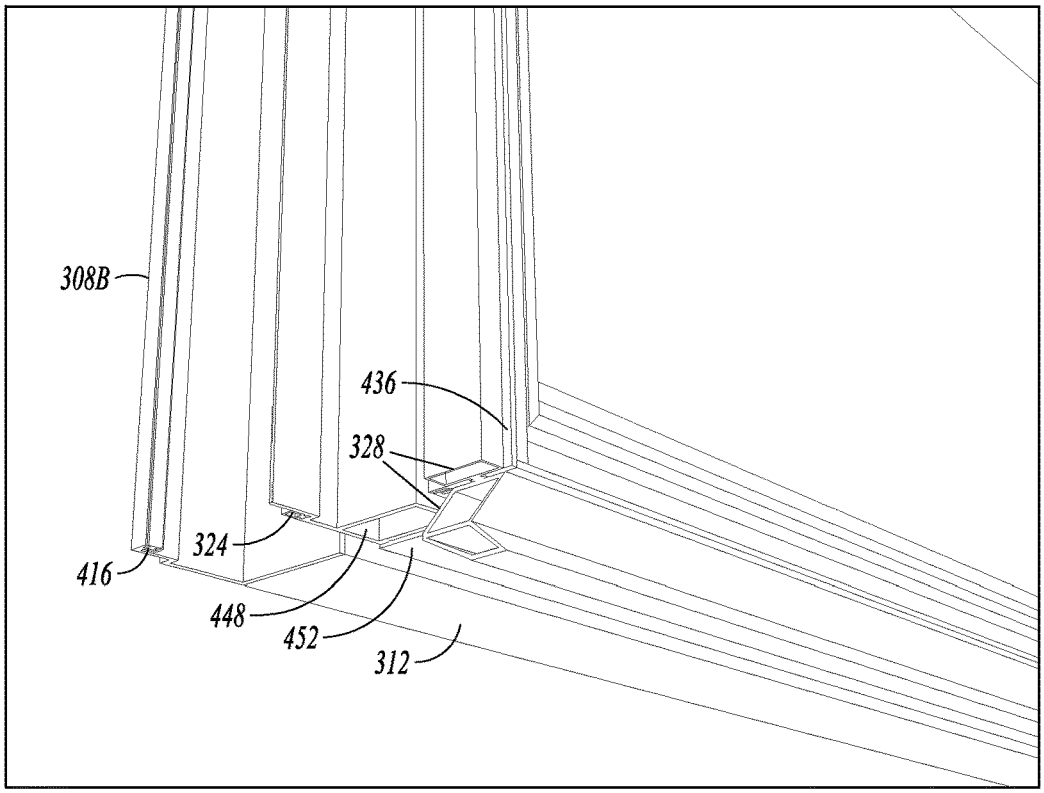
Figure 4D:
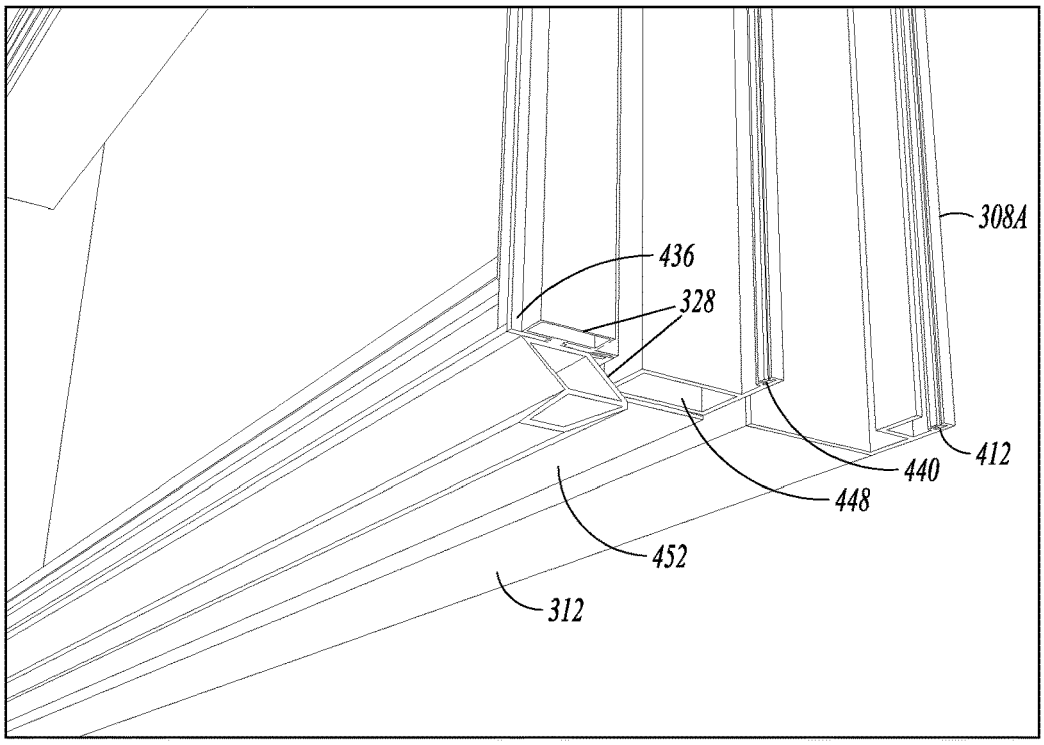

4A-4D illustrate closer views of the periphery of the curtainwall unit illustrated in FIGS. 3A-3D. FIG. 4A illustrates a view of a top left portion of the curtainwall unit 304. FIG. 4B illustrates a view of a top right portion of the curtainwall unit 304. FIG. 4C illustrates a bottom left view of a curtainwall unit, such as the curtainwall unit 304. FIG. 4D illustrates a bottom right view of a curtainwall unit, such as the curtainwall unit 304. The curtainwall unit 304 may include an air seal gasket 320, a plastic isolator 416, a horizontal gutter 316, a water barrier gasket 324, a male mullion 308*b*, a rainscreen gasket 328, a plastic blade 436, a gasket 440, a female mullion 308*a*, a protected vertical chamber 448, a plastic thermal shield 452, and a horizontal sill 456. The horizontal gutter 316 may also be referred to as a horizontal frame member. The horizontal gutter 316 may include the rear channel 408 formed between the air seal gasket 320 and the water barrier gasket 324. As will be described in more detail below, various aspects of the present subject matter provide improved venting to equalize pressure across the water gasket line and to drain moisture from the channel behind the water gasket line out to the exterior in front of the installed curtainwall system. The path includes a protected horizontal chamber at least partially below the rear channel 408, and the protected vertical chamber 448 in each vertical mullion 308*a* and 308*b*. Apertures within the rear channel 408 and the protected vertical chamber 448 provide fluid communication from the rear channel 408 at the top rear portion of the curtainwall unit 304 through the protected horizontal chamber and through the protected vertical chamber 448 and out of the bottom of the protected vertical chamber 448 (see FIG. 4C) to the exterior at the bottom front of the curtainwall unit 304. This drainage is shown in more detail in FIGS. 6A-6F.

Figure 5A:
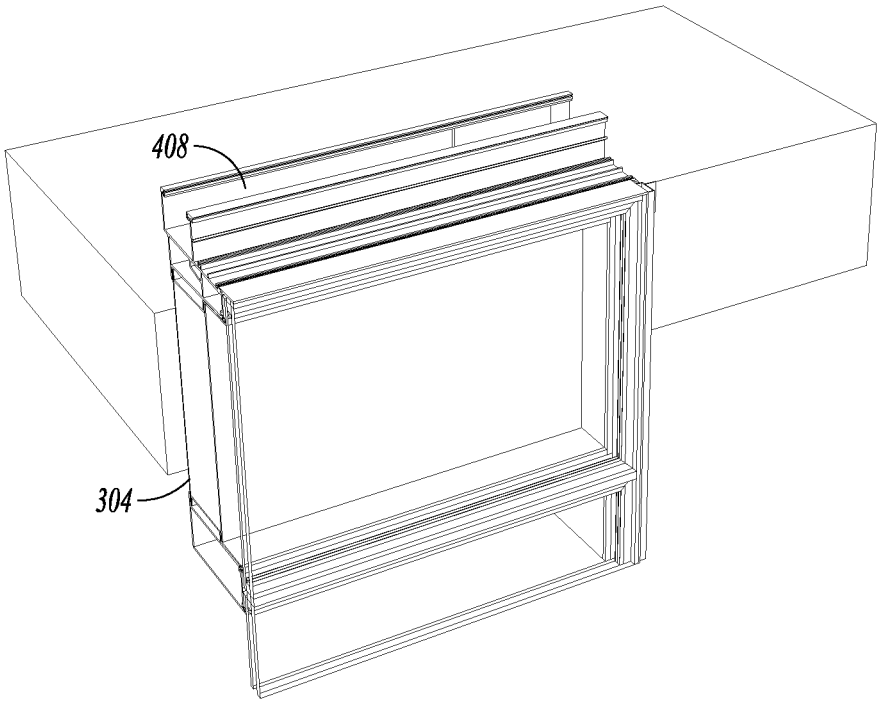
FIGS. 5A-5H illustrate an example of an installation sequence for a four-unit region of the curtainwall system, where two units are stacked on two other units.
Figure 5B:
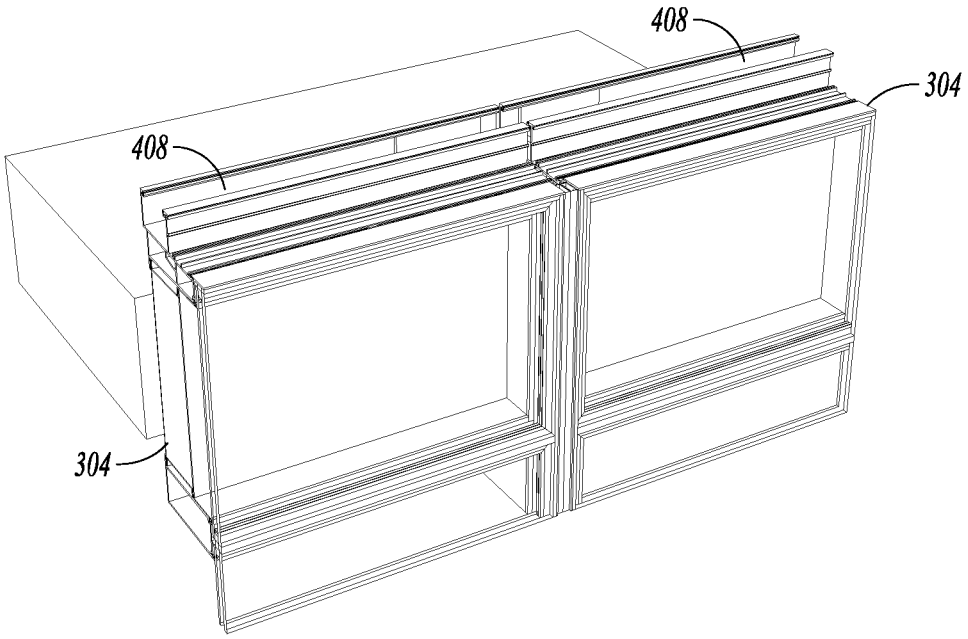
Figure 5C:
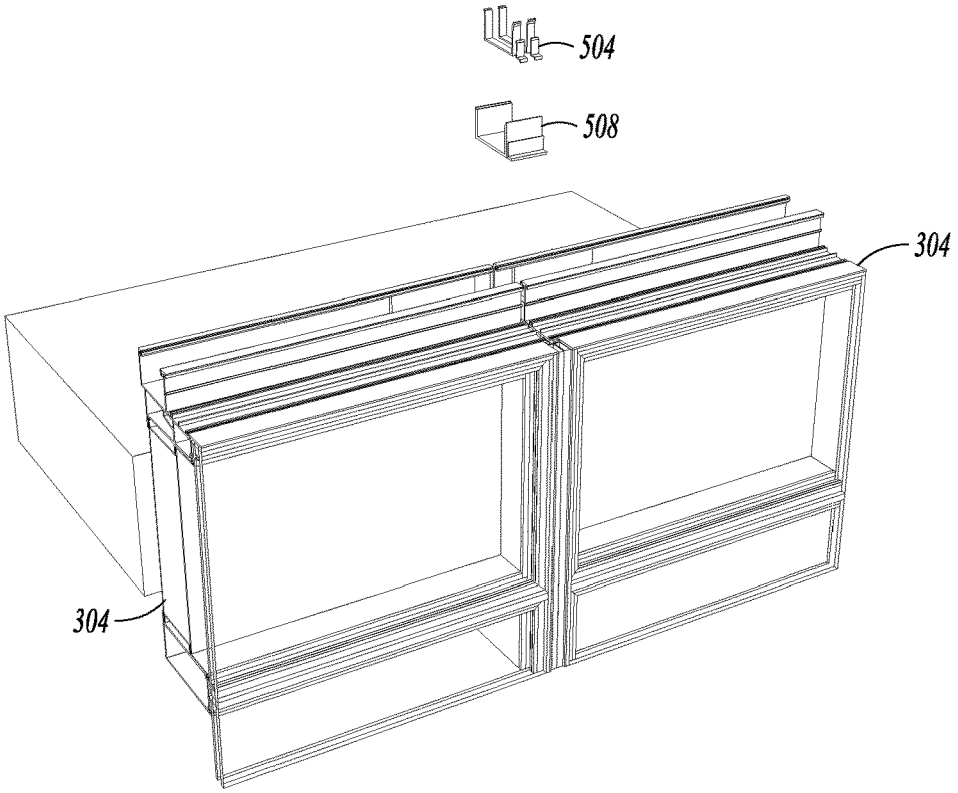
Figure 5D:
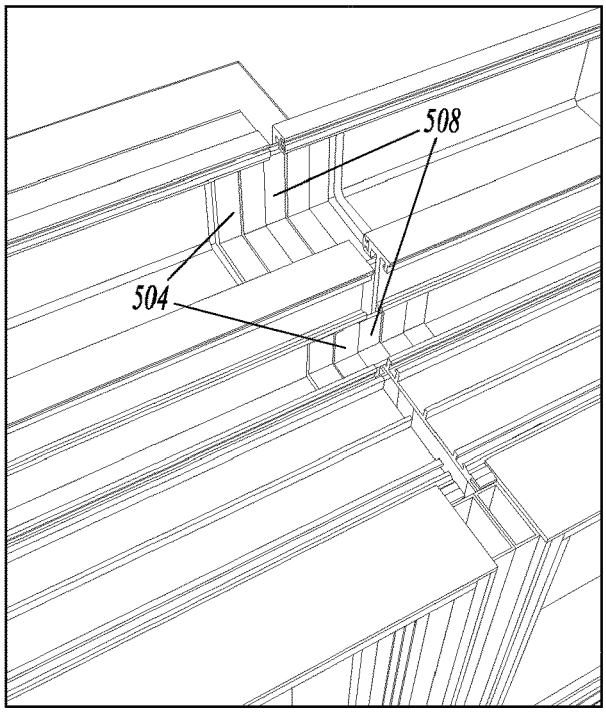

FIGS. 5A-5H illustrate an installation sequence for a four-unit region of the curtainwall system 100, where two curtainwall units 304 may be stacked on two other curtainwall units 304. As illustrated in FIGS. 5C and 5D, rather than using a wet sealant to seal the splice as conventionally used during onsite installation, a waterproof preformed silicone sponge gasket 508 may be placed across a joint between two curtainwall units 304 and secured in place using spring clips 504 to provide a water and air seal within the rear channels 408 of the curtainwall units 304. The spring compression clip may include an aluminum extrusion designed to elastically deform and snap into the mating gutter extrusion, thereby compressing the silicone sponge gasket using an appropriate amount of pressure to create a weathertight "seal" between adjacent units of the curtainwall system.

Figure 5E:
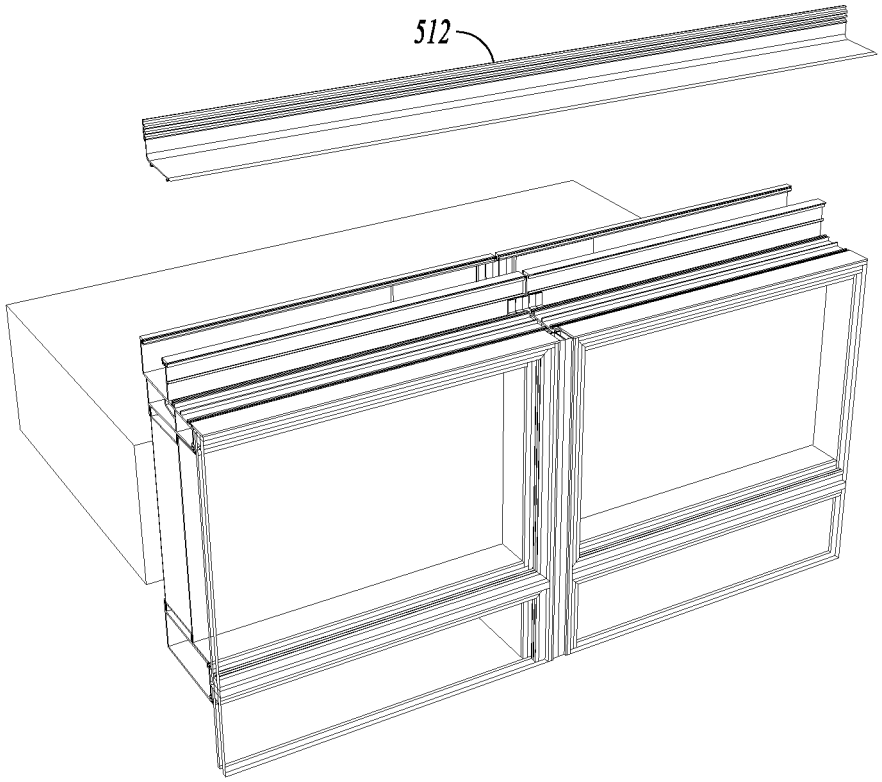
Figure 5F:
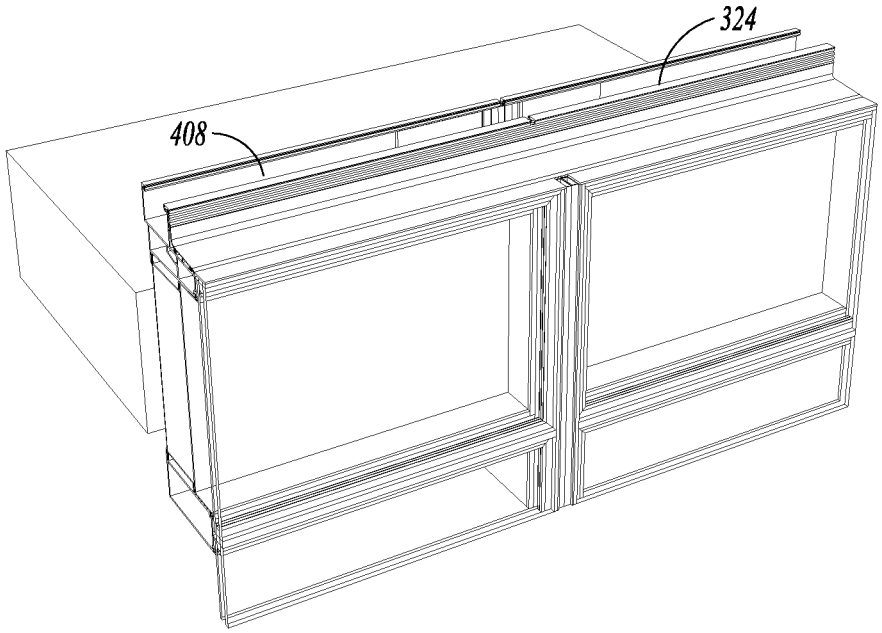
Figure 5G:
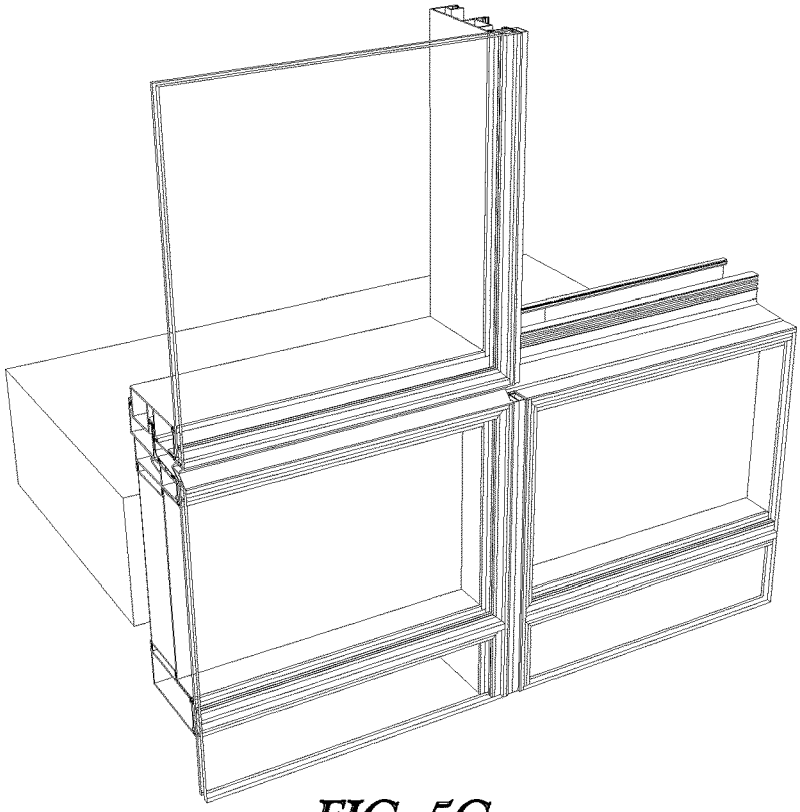
Figure 5H:
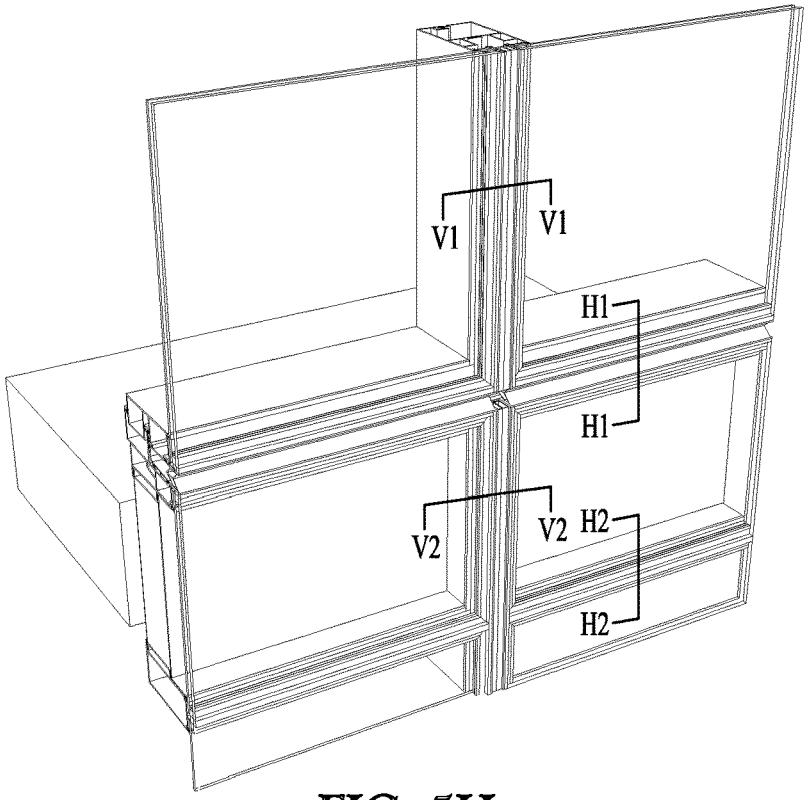

The silicone sponge gasket 508 may beneficially provide a flexible seal that can flex under wind load and seismic activity, while still maintaining the weathertight seal. Additionally, after forming a four-way junction by stacking four curtainwall units as illustrated in FIG. 5H, a silicone plug maybe inserted from the back where the four curtainwall units meet. The plug may be temporally compressed within the fingers. For example, the plug may resemble an ear plug, as it may be rolled between the fingers to reduce the diameter of the plug. The compressed plug may then be inserted into the hole where it expands to plug the hole and maintain an air seal at the air seal gasket line of the system. The putty may be made from a pliable material which may create an effective air seal while allowing for the required movements (live load slab deflection, thermal, seismic, etc.). The silicone plug may expand to fill the gap between the curtainwall units and may help maintain an air seal line at the back of the curtainwall system. Thus use of the silicone gasket 508 and plug maintains the flexible seals at the gasket lines between the units, as well as avoids the use of wet seals during the on-site installation process. As illustrated in FIG. 5E, a water barrier gasket 512 may be installed on the gutter in front of the rear channel 408. Splices of the water barrier gasket 512 may be made toward the center of the curtainwall units 304, such that a water barrier may be formed at the joints between the curtainwall units 304. Thus, as illustrated and described in detail with respect to FIGS. 6A-6F, water that drains down through a protected vertical drainage chamber 448 in the vertical mullion near the joints between the curtainwall unit 304 will encounter the water barrier gasket 512 and drain out toward the front of the curtainwall system 100. The water barrier gasket 512 may provide a water barrier gasket line in front of the rear channel 408.

Figure 6A:
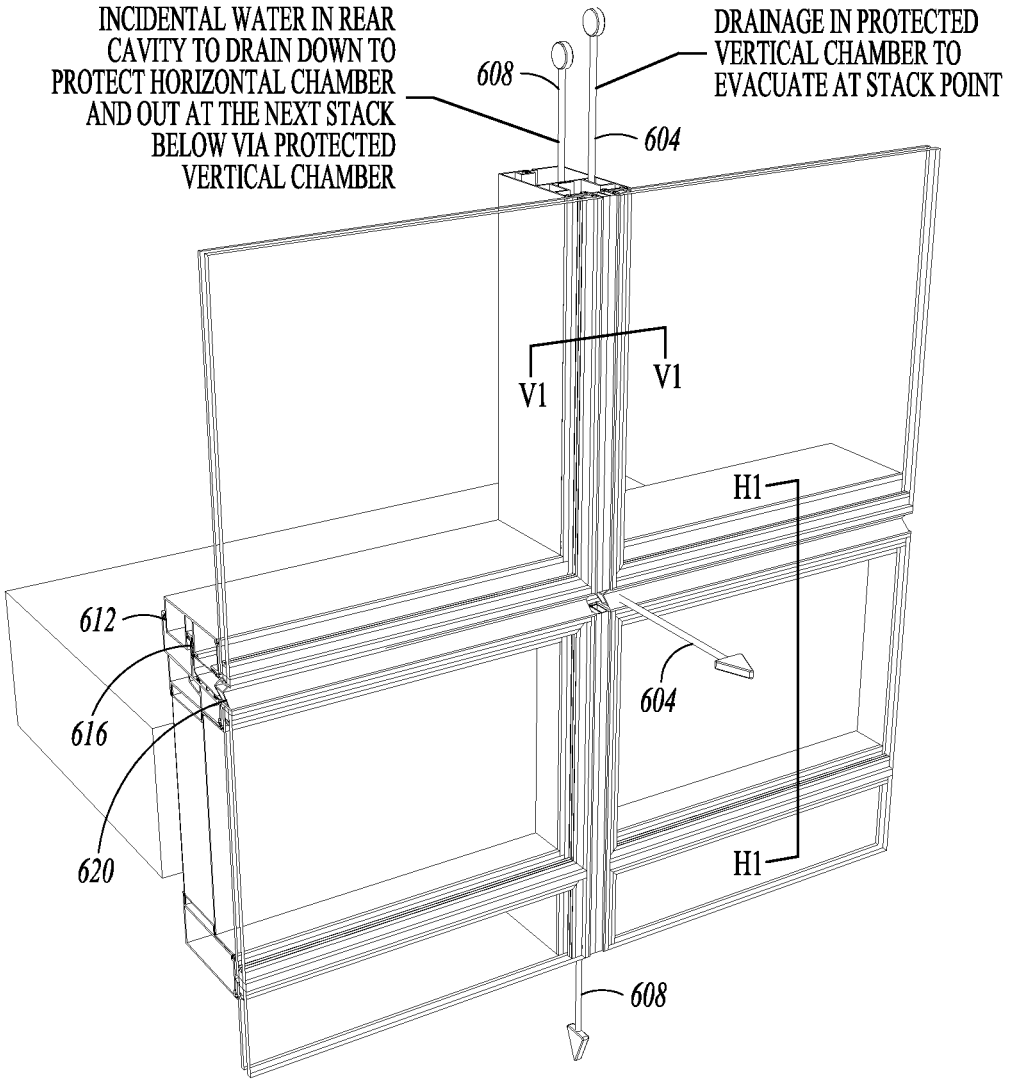
FIGS. 6A-6F illustrate air and water paths within an example of a curtainwall system.
Figure 6B:
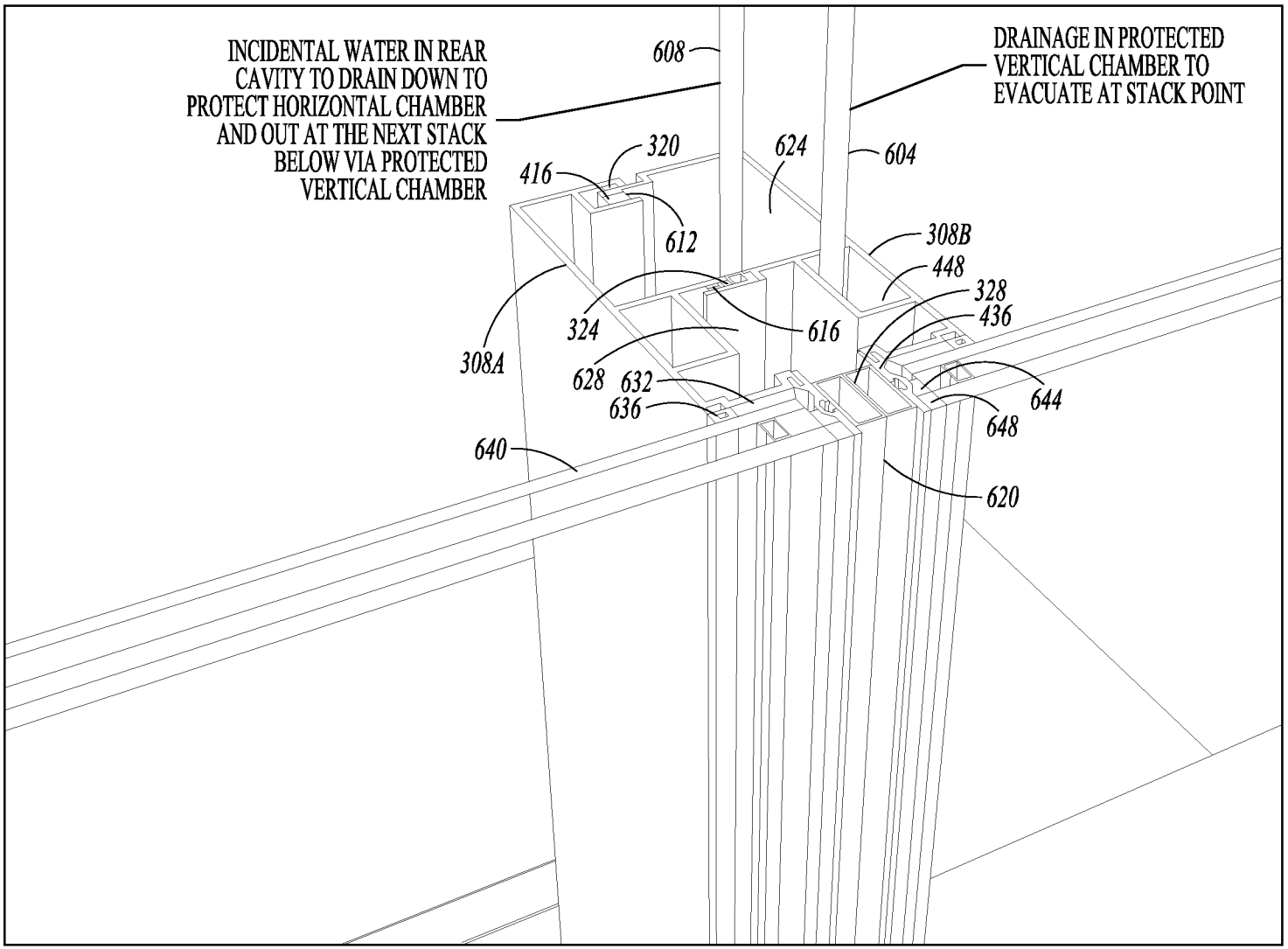
Figure 6C:
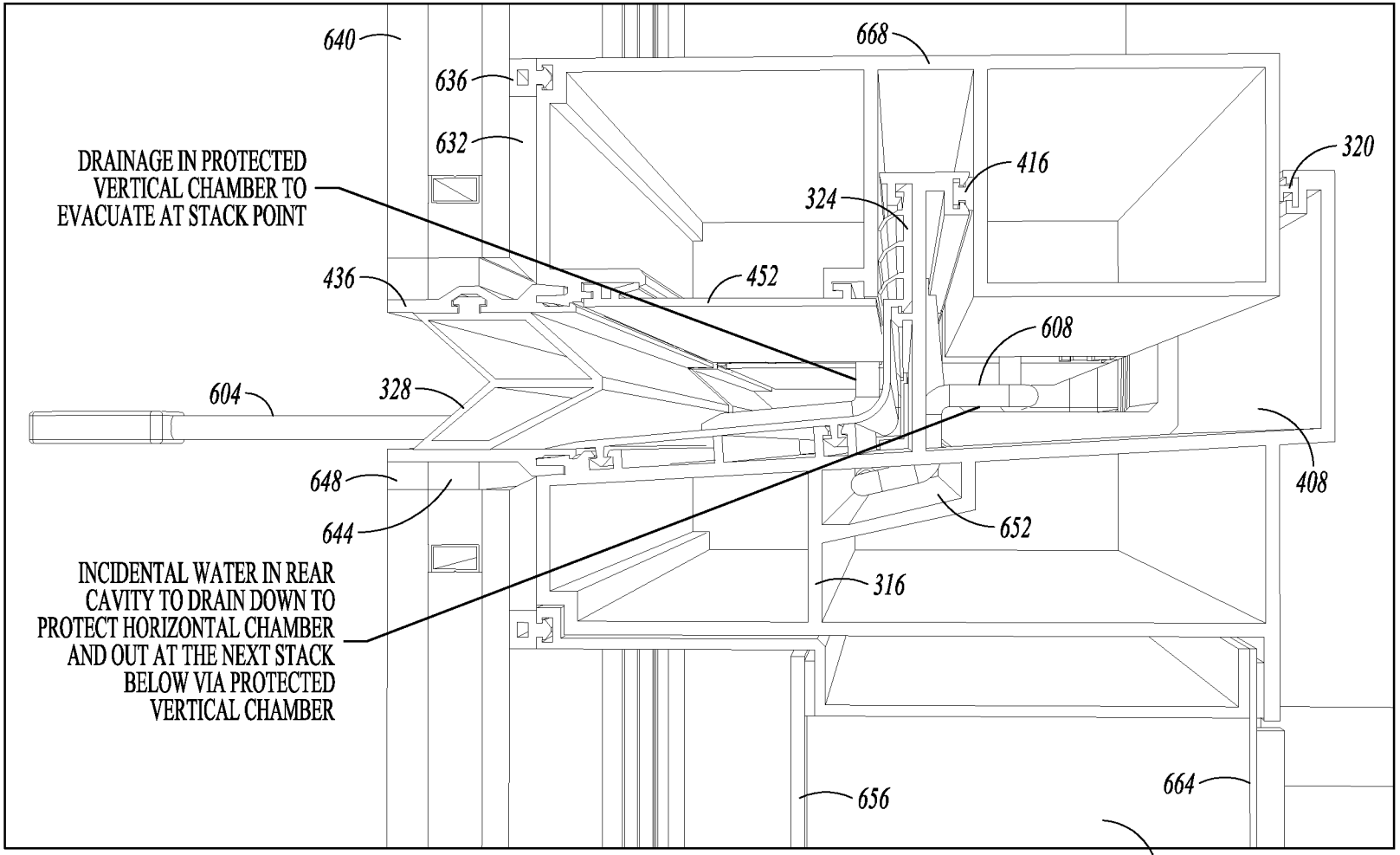
Figure 6D:
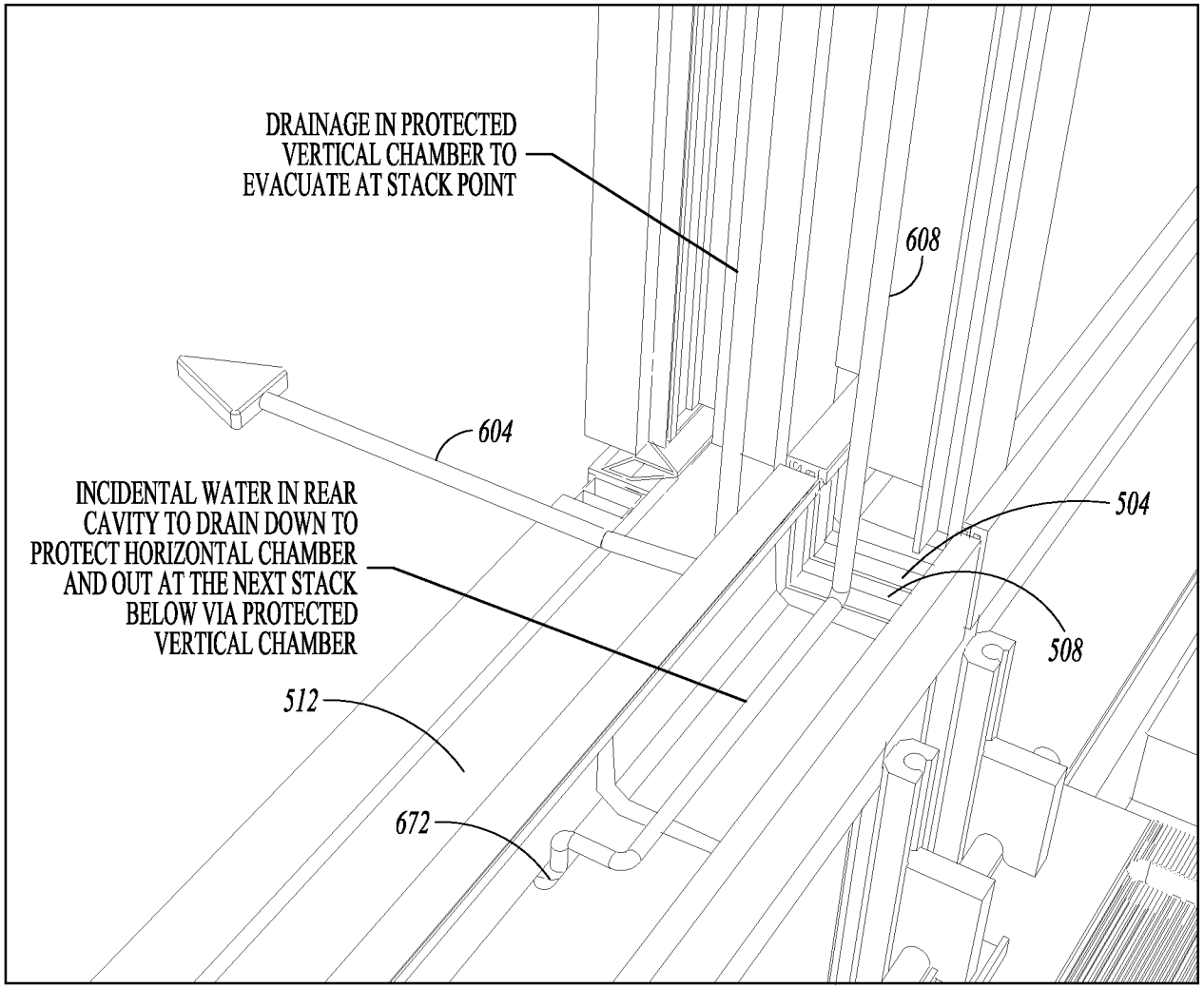
Figure 6E:
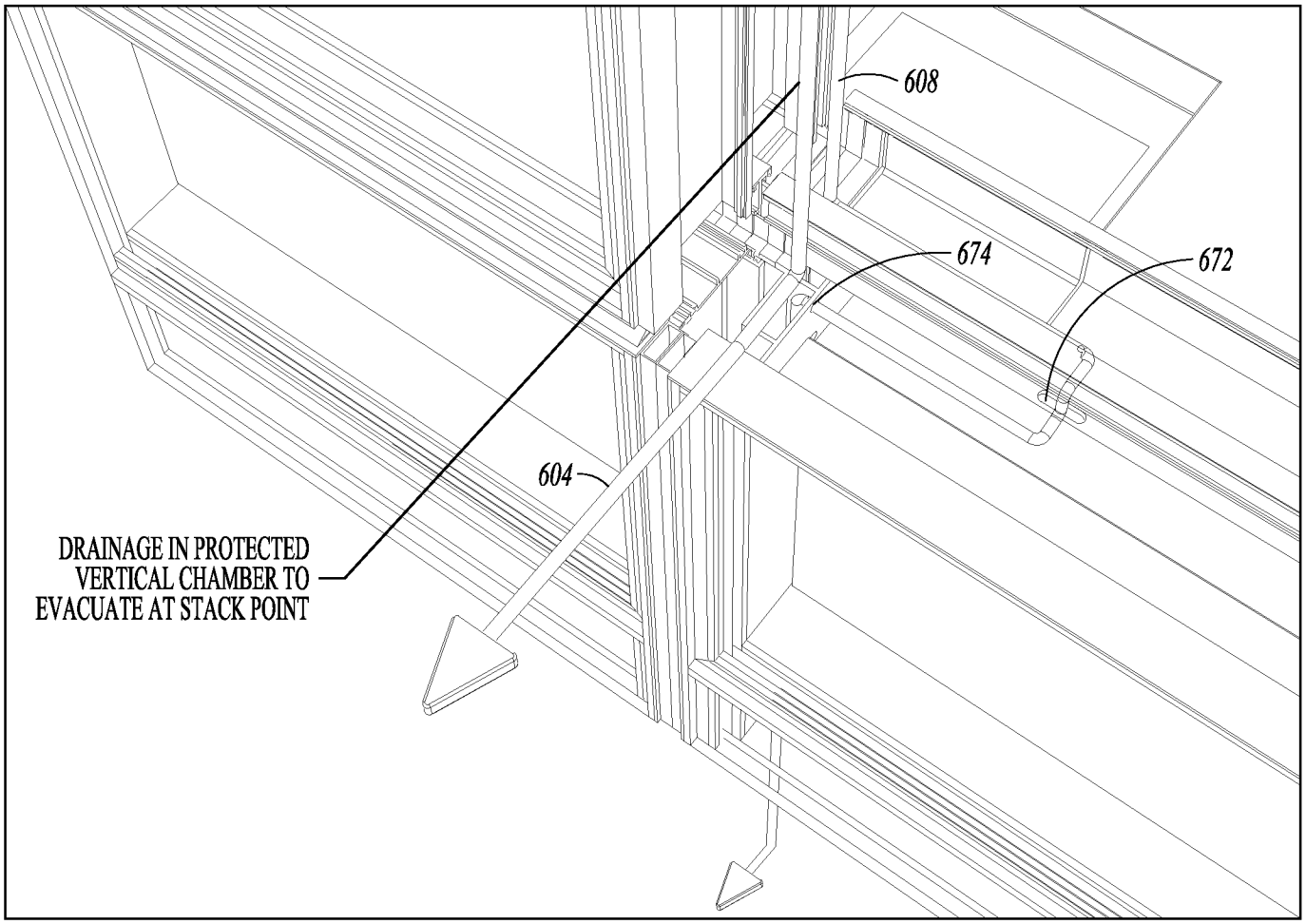
Figure 6F:
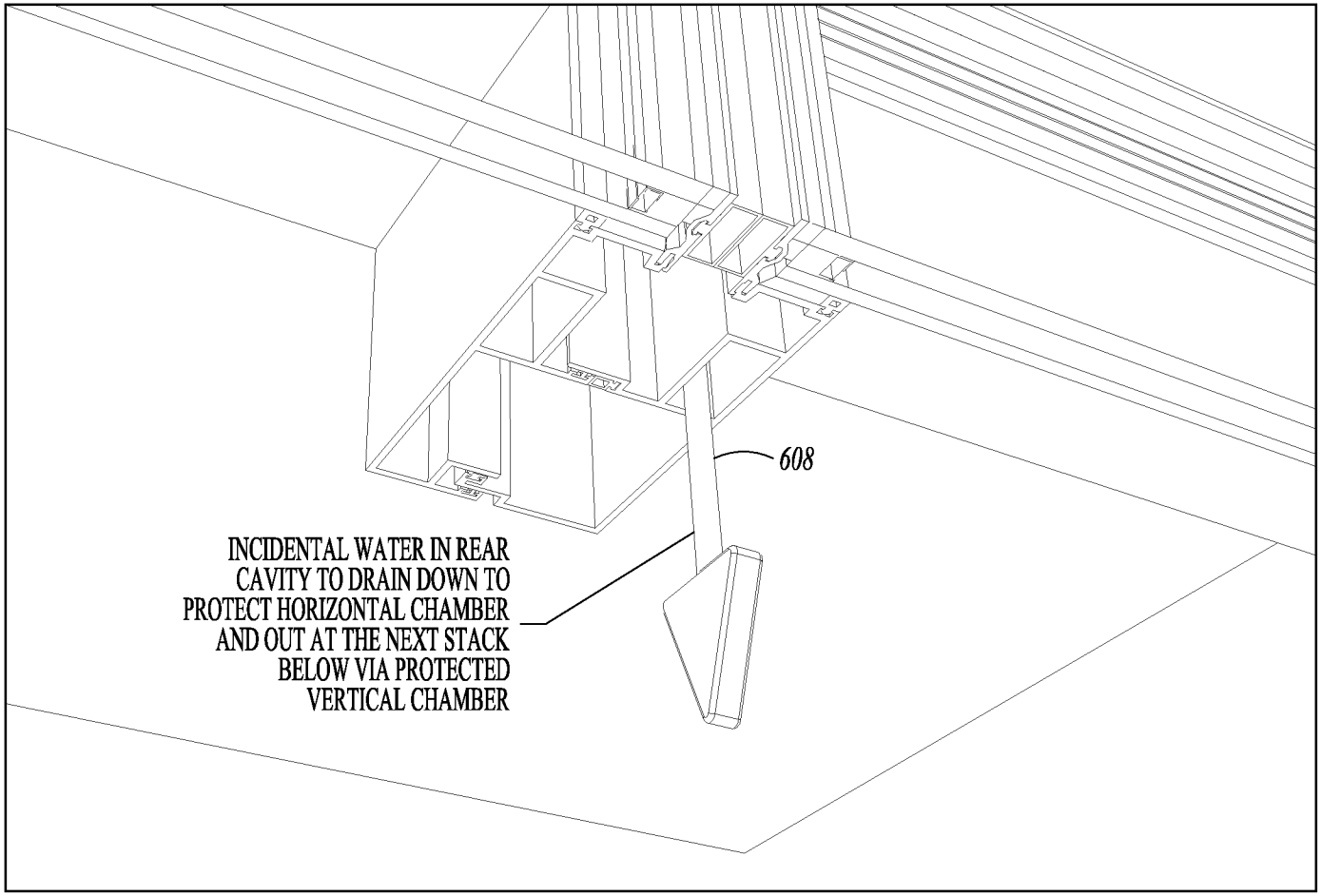

FIGS. 6A-6F illustrate the air and water paths 604, 608 within the curtainwall system 100. The vertical mullions 308*a*, 308*b* of adjacent curtainwall units form a rear cavity 624 between a water barrier gasket line 616 and an air seal gasket line 612, and further form a front cavity 628 between the water barrier gasket line 616 and a rain screen gasket line 620. Path 608 illustrates that incidental water that may be present in the rear cavity 624 may drain into the rear chamber 408 of the horizontal gutter 316 on top of the curtainwall units below, where the water may then drain into a protected horizontal chamber 652, and then into the protected vertical chamber 448 for evacuation at the bottom of the curtainwall unit as illustrated by path 604. FIG. 6B shows water draining through only one of the protected vertical chambers 448. It is understood that water may drain into both of the illustrated protected vertical chambers 448 from the corresponding protected horizontal chamber in their respective curtainwall unit. A silicone bed gasket 636, structural silicone 632, silicone backer 644, and silicone weatherseal 648 may provide a seal between the insulated glass 640 and the vertical mullions 308*a* and 308*b*. FIGS. 6C-6F illustrate that water draining (path 608) from the rear cavity 624 of a vertical mullion in the top unit into the rear channel 408 of the gutter 316 of the bottom unit, and then down through an opening 672 into the protected horizontal chamber 652 where it moves back toward the vertical mullion, but enters in the protected vertical chamber 448 via an opening in the 674 in the vertical mullion. As illustrated, the opening 672 may be offset from the vertical mullion. FIG. 6C also illustrates drainage (path 604) from the protected vertical chamber 448 for the top unit contacting the water barrier gasket 512 on the joint, which causes the water exiting the protected vertical chamber 448 to move out through the joint between the rainscreen gaskets 328 of horizontally-adjacent units to the exterior (see FIG. 6D). This drainage pathway also serves as a venting/air pathway to equalize pressure across the water seal gasket line 616, to avoid water seepage that could otherwise be drawn inward if there was a pressure differential across the water seal gasket 324. Assuming the water seal gasket line 616 remains intact, exterior water would have to pass the rain screen gasket 328, travel up one floor through the protected vertical chamber 448, and enter the protected horizontal chamber 652 before it can enter the rear portion of the frame structure between the water seal gasket line 616 and the air seal gasket line 620. As this would require a very high pressure differential to draw water up to the next story, water is prevented from entering the rear portion of the curtainwall system 100. Yet, this pathway also provides adequate venting to minimize or eliminate pressure differentials across the water seal gasket line 616, which makes it even more improbable that a transient pressure differential would develop to draw water up to the next story and enter the rear portion of the curtain wall system.

Figure 7A:
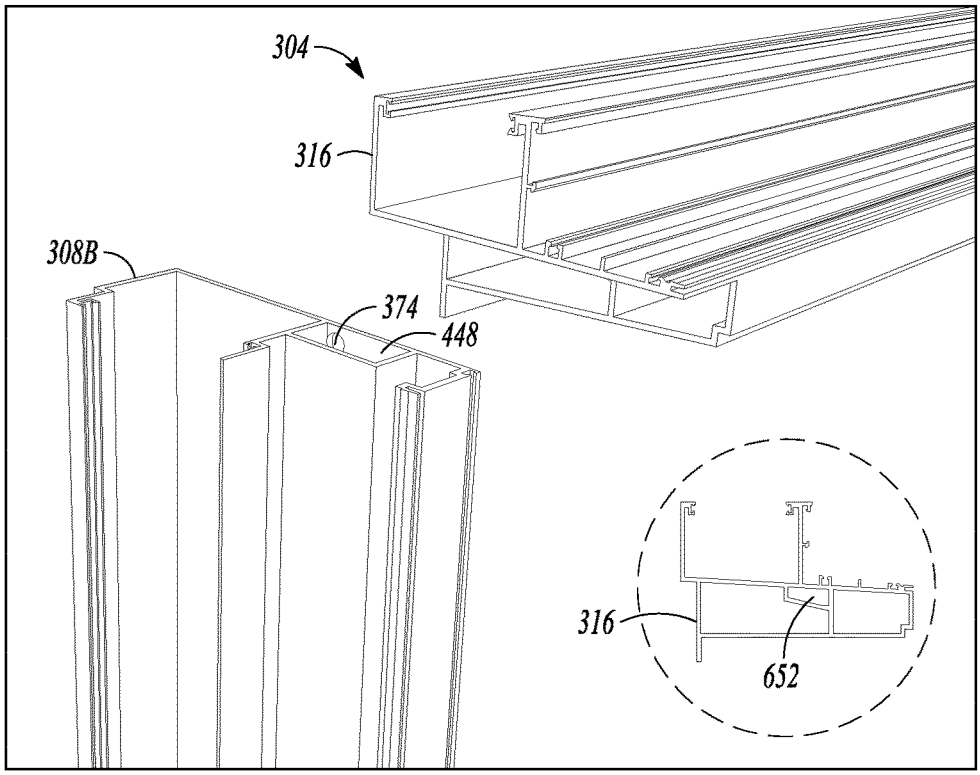
FIGS. 7A-7B illustrate an example of a framing connection for a curtainwall unit between a horizontal gutter on a top of the unit and a vertical mullion, thereby illustrating a relationship between the protected horizontal drainage chamber and the protected vertical drainage chamber.
Figure 7B:
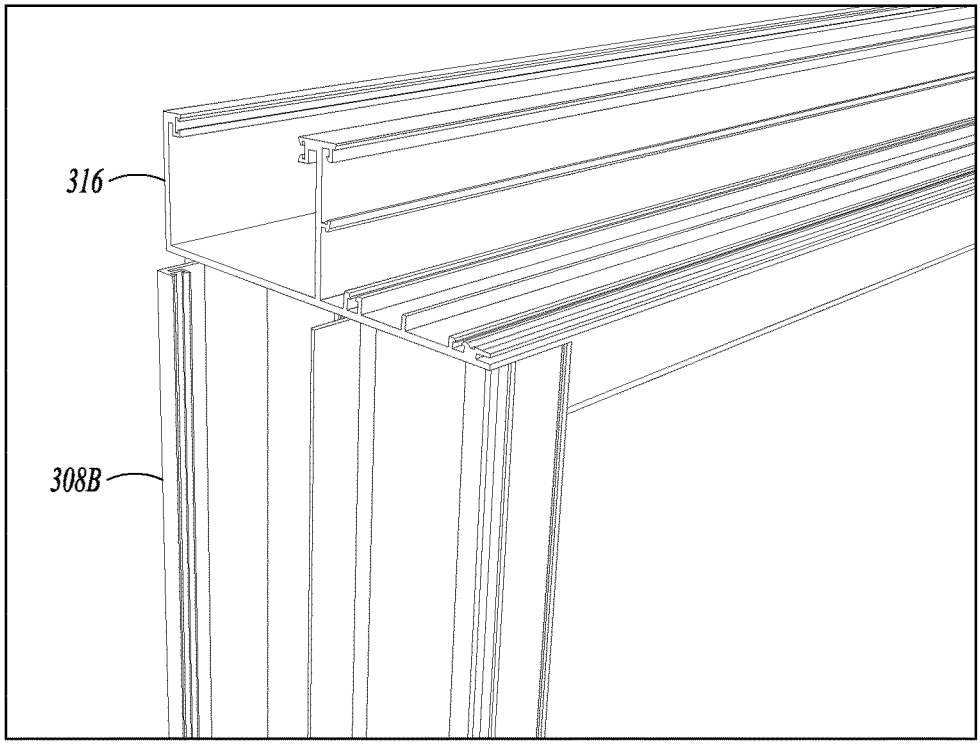

FIGS. 7A-7B illustrate a framing connection for a curtainwall unit 304 between a horizontal gutter 316 on a top of the curtainwall unit 304 and a vertical mullion 308, thereby illustrating a relationship between the protected horizontal drainage chamber 652 and the protected vertical drainage chamber 448. FIGS. 7A-7B illustrate that the hole 374 in the vertical mullion 308*b* may provide fluid communication between the protected horizontal chamber 652 and the protected vertical chamber 448.

Figure 8A:
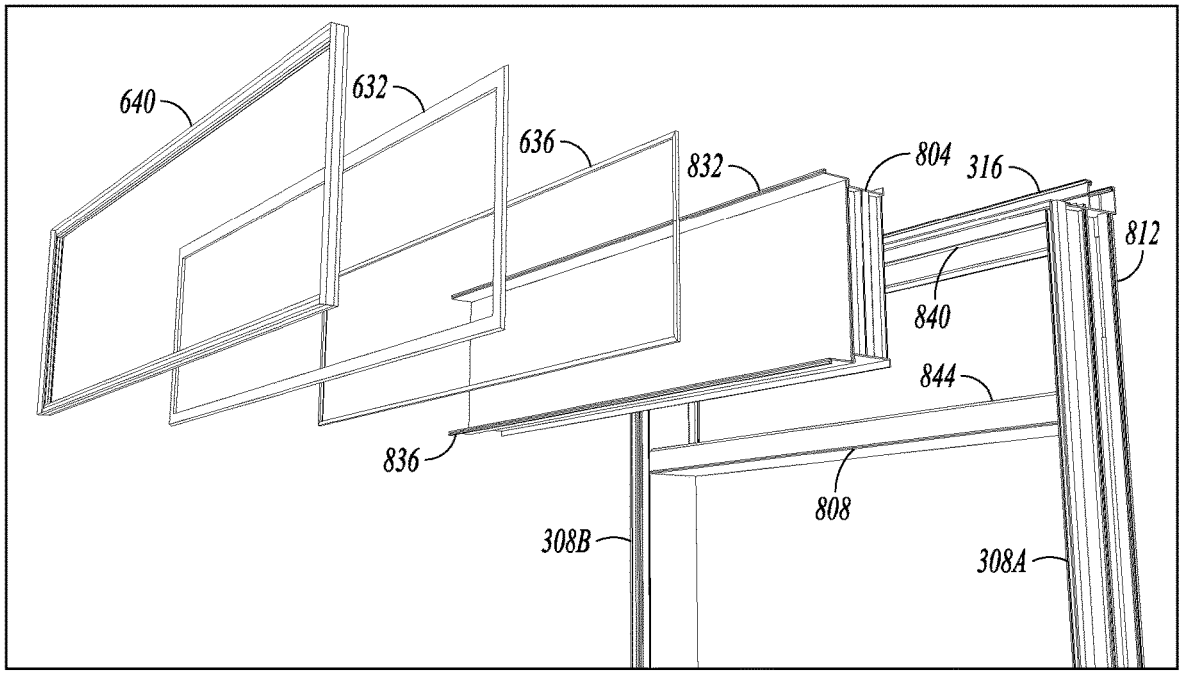
FIG. 8A illustrates an exploded view of an embodiment of a shadowbox assembly with respect to a curtainwall frame.
Figure 8B:
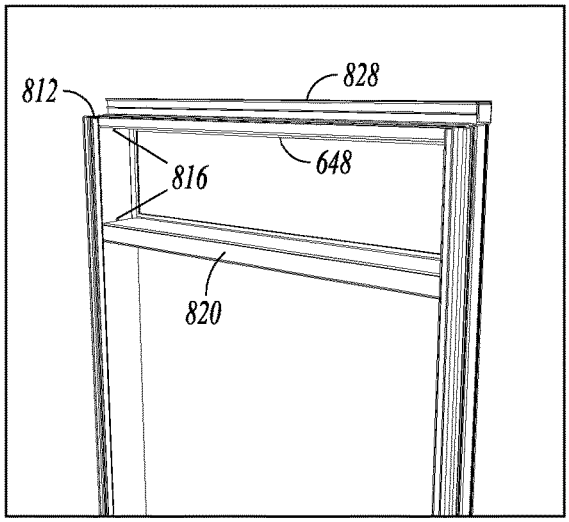
FIG. 8B illustrates a curtainwall frame.
Figure 8C:
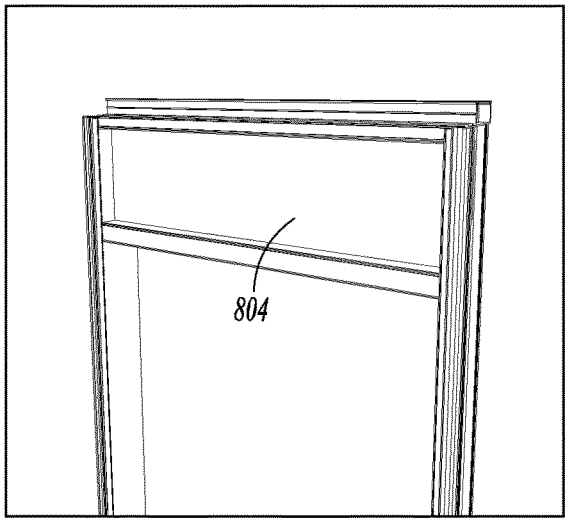
FIG. 8C illustrates the shadowbox assembly installed within the curtainwall unit.
Figure 9A:
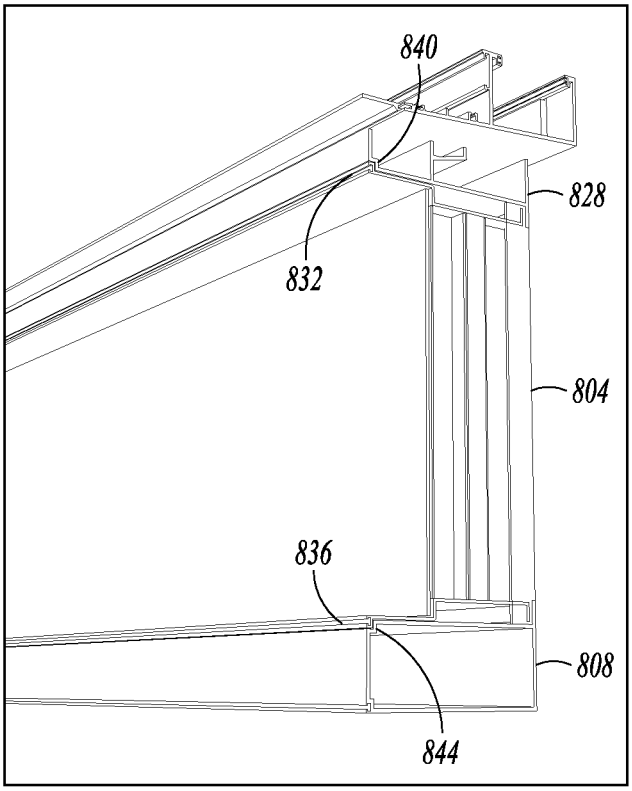
FIGS. 9A-9D illustrate an example of an assembly sequence for a shadowbox embodiment.
Figure 9B:
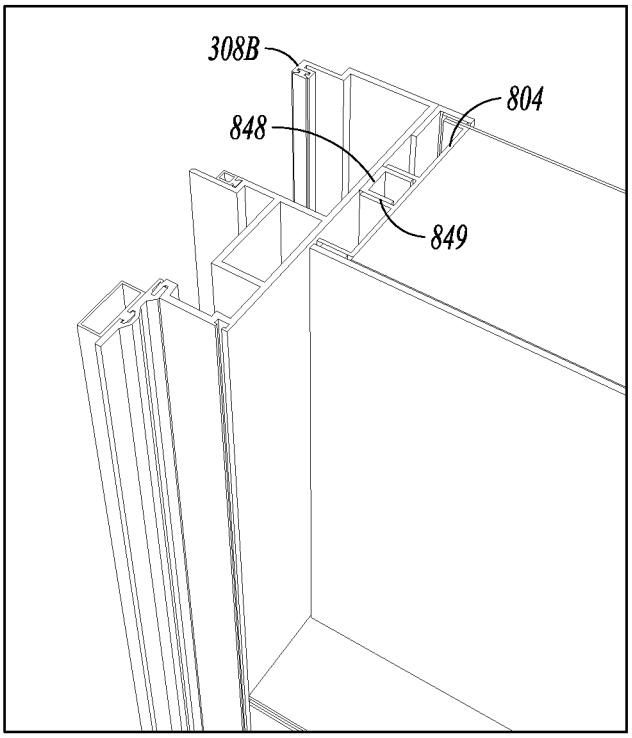
Figure 9C:
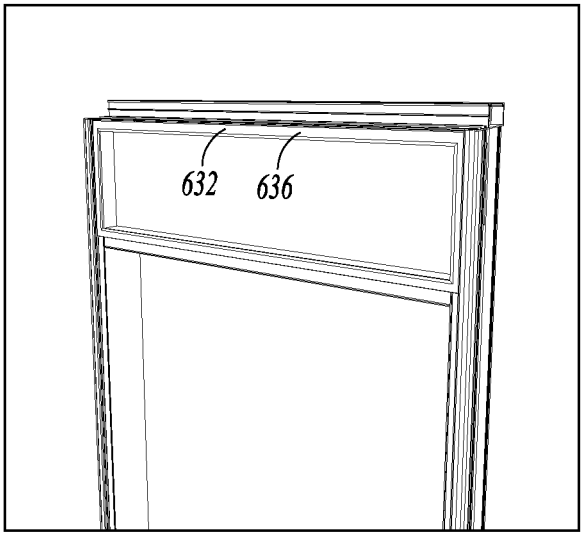
Figure 9D:
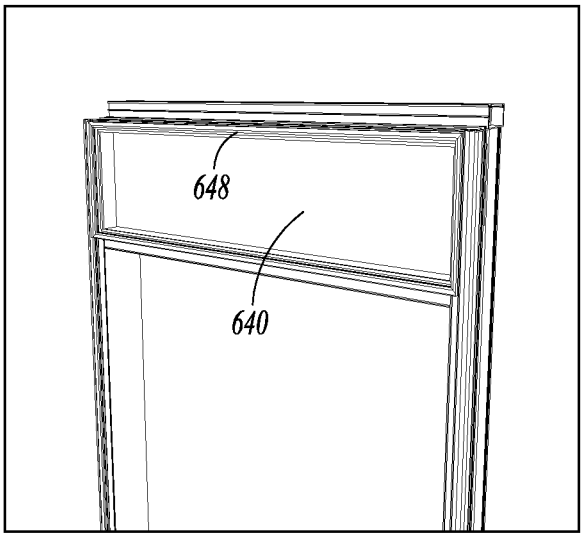

FIG. 8A illustrates an exploded view of an embodiment of a shadowbox assembly 804 with respect to a curtainwall frame 812, FIG. 8B illustrates a curtainwall frame 812, and FIG. 8C illustrates the shadowbox assembly 804 installed within the curtainwall unit. The shadowbox assembly 804 may be inserted into the space defined by the horizontal gutter 316, the head horizontal mullion 820, and both vertical mullions 308*a* and 308*b*. The shadowbox assembly 804 may have a top frame member with a front lip 832 and a bottom frame member with a front lip 836. The shadowbox assembly 804 may be inserted until a rear of the shadowbox assembly 804 contacts the reveals and a notch 840 of the horizontal gutter 316 contacts the lip 832 in the top frame member, and the notch 844 of the head horizontal mullion 820 contacts the lip 836 in the bottom frame member. FIG. 8B illustrates vent holes 816 for the shadowbox assembly, which allows air and moisture to move into the protected vertical chamber 448, such as to reduce heat build-up in the shadowbox assembly 804. A silicone bed gasket 636 and structural silicone 632 may be placed around a front periphery of the inserted shadowbox assembly 804. The installation of the insulated glass 640 onto the frame holds the shadowbox assembly 804 in place. Furthermore, opposing ends of the shadowbox assembly 804 include fixed channels configured to be fastened to the vertical mullions 308*a* and 308*b*. The shadowbox assembly 804 includes vertical frame members with receiving channels configured to receive the fixed channels. The receiving channels and the fixed channels cooperate to restrict movement of the shadowbox assembly perpendicular to a glass plane on a front of the shadowbox assembly 804, but allows the shadowbox assembly 804 to float to allow for thermal expansion and contraction of an aluminum panel within the shadowbox assembly 804.

FIGS. 9A-9D illustrate an example of an assembly sequence for a shadowbox, such as shadowbox assembly 804. The shadowbox assembly 804 may include a head horizontal mullion 808, a horizontal gutter 828, a front lip 832 of a top frame member, a front lip 836 of a bottom frame member, a notch 840 of the horizontal gutter, a notch 844 of the head horizontal mullion, an aluminum vertical channel 848, a floating channel 849, a male vertical mullion 308*b*, structural silicon 632, a silicone bed gasket 636, a silicone weatherseal 648, and insulated glass 640. The aluminum vertical channel 848 may be attached to the male vertical mullion 308*b*, and the floating channel 849 may be attached to the shadowbox assembly 804. The aluminum vertical channel 848 in cooperation with the floating channel 849 may form a connection between the male vertical mullion 308*b* and the shadowbox assembly 804, such as to allow for thermal expansion and contraction at the connection while still maintaining the connection to the male vertical mullion 308*b*. Other structural components (e.g. pin/Tinnerman clip) may be used to provide the floating connection that allows for thermal expansion and contraction.

The floating channel 849 and the aluminum vertical channel 848 may cooperate to restrict movement of the shadowbox assembly 804 perpendicular to the insulated glass 640 on a front of the shadowbox assembly 804, but may allow the shadowbox assembly 804 to float to allow for thermal expansion and contraction within the shadowbox assembly 804. The shadowbox assembly 804 may be inserted until a notch 840 of the horizontal gutter 828 contacts a lip 832 of the top frame member, and the notch 844 of the head horizontal mullion 820 contacts the front lip 836 of the bottom frame member. Rather than using an extrusion integral to the shadow box assembly to retain the shadowbox, some embodiments may use a separate loose part between the insulated glass and the frame to mate with the lip and retain the shadowbox. The installation of the insulated glass 640 into the frame may hold the shadowbox assembly in place.

FIGS. 10A, 10B, 10C-1 and 10C-2, and 10D-1 and 10D-2 illustrate views of a first embodiment respectively taken along view lines H1-H1, H2-H2, V1-V1 and V2-V2 of FIG. 5H.

Figure 10A:
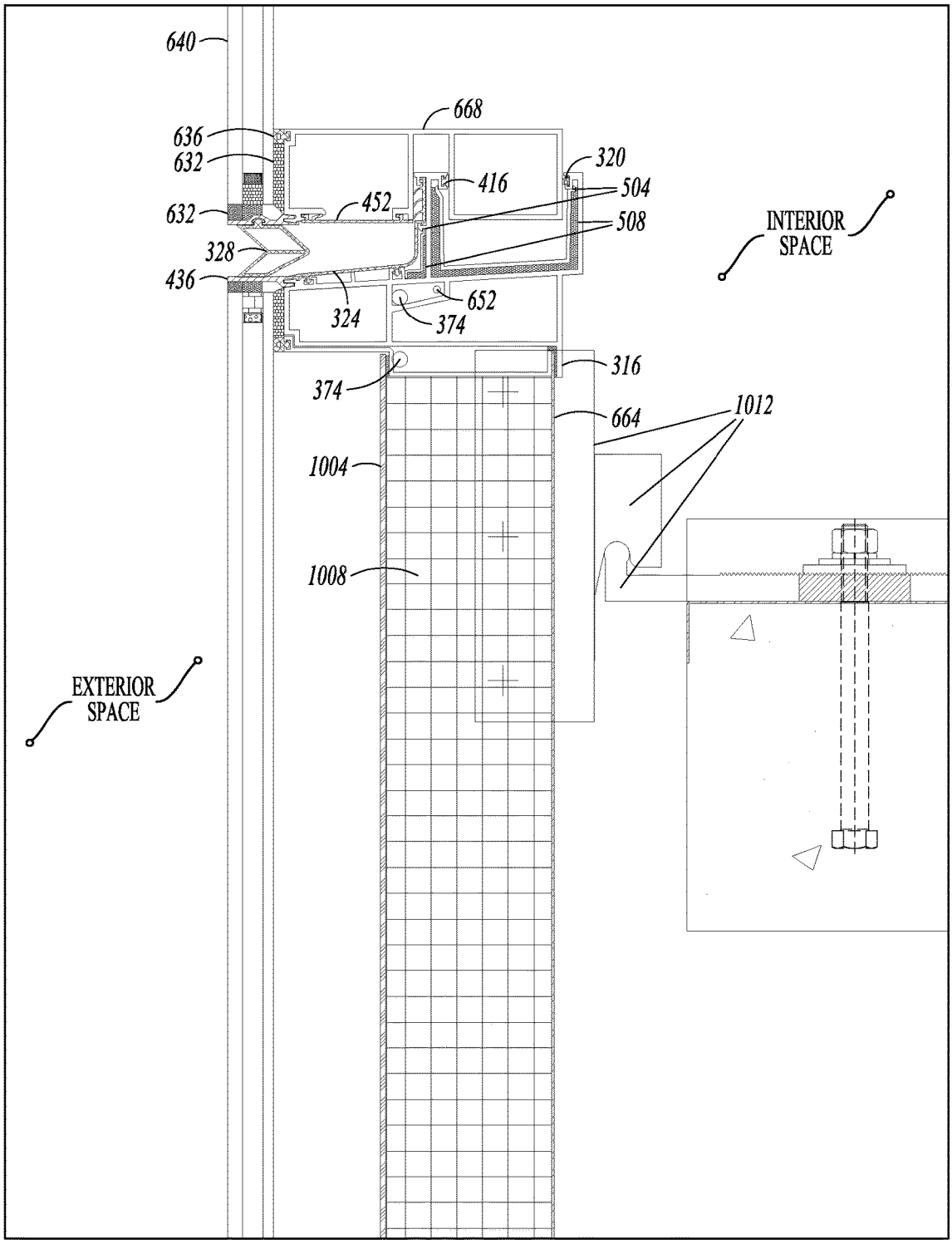

The horizontal section illustrated in FIG. 10A includes insulated glass 640, spacer gasket 636, silicone sealant 632, plastic thermal shield 452, exterior rainscreen gasket 328, plastic blade 436, continuous water barrier gasket 324, hole 374 in the vertical mullion 308*b*, an aluminum shadowbox panel 1004, aluminum horizontal sill 668, plastic isolator 416, air seal gasket 320, spring compression clips 504, silicone sponge gasket 508, protected horizontal chamber 652, horizontal gutter 316, galvanized steel sheet 664, and an extruded aluminum anchor component 1012. The aluminum shadowbox panel 1004 may provide an opaque barrier, such as to hide a floor slab, perimeter structure, or other building element such as a mechanical or electrical system. The insulation 1008 may provide a thermal barrier, such as to reduce the heating or cooling requirements of the building. The extruded aluminum anchor component 1012 may provide a connection for mounting to the building. The galvanized steel sheet 664 may provide an air, water, and vapor barrier between the exterior and interior. A silicone bed gasket 636 and structural silicone 632 may provide a seal between the insulated glass 640 and the vertical mullions 308*a* and 308*b*. The rain screen gasket 328 may allow for weeping of water and pressure equalization of interior cavities. The hole 374 in the vertical mullion 308 may provide fluid communication between the protected horizontal chamber 652 and the protected vertical chamber 448. The spring compression clips 504 may be used to provide a water and air seal within the rear channels of the curtainwall units, such as by holding the silicone gasket 508 in place. The silicone gasket 508 may provide a flexible seal that can flex under wind load and seismic activity, while still maintaining the seal.

Figure 10B:
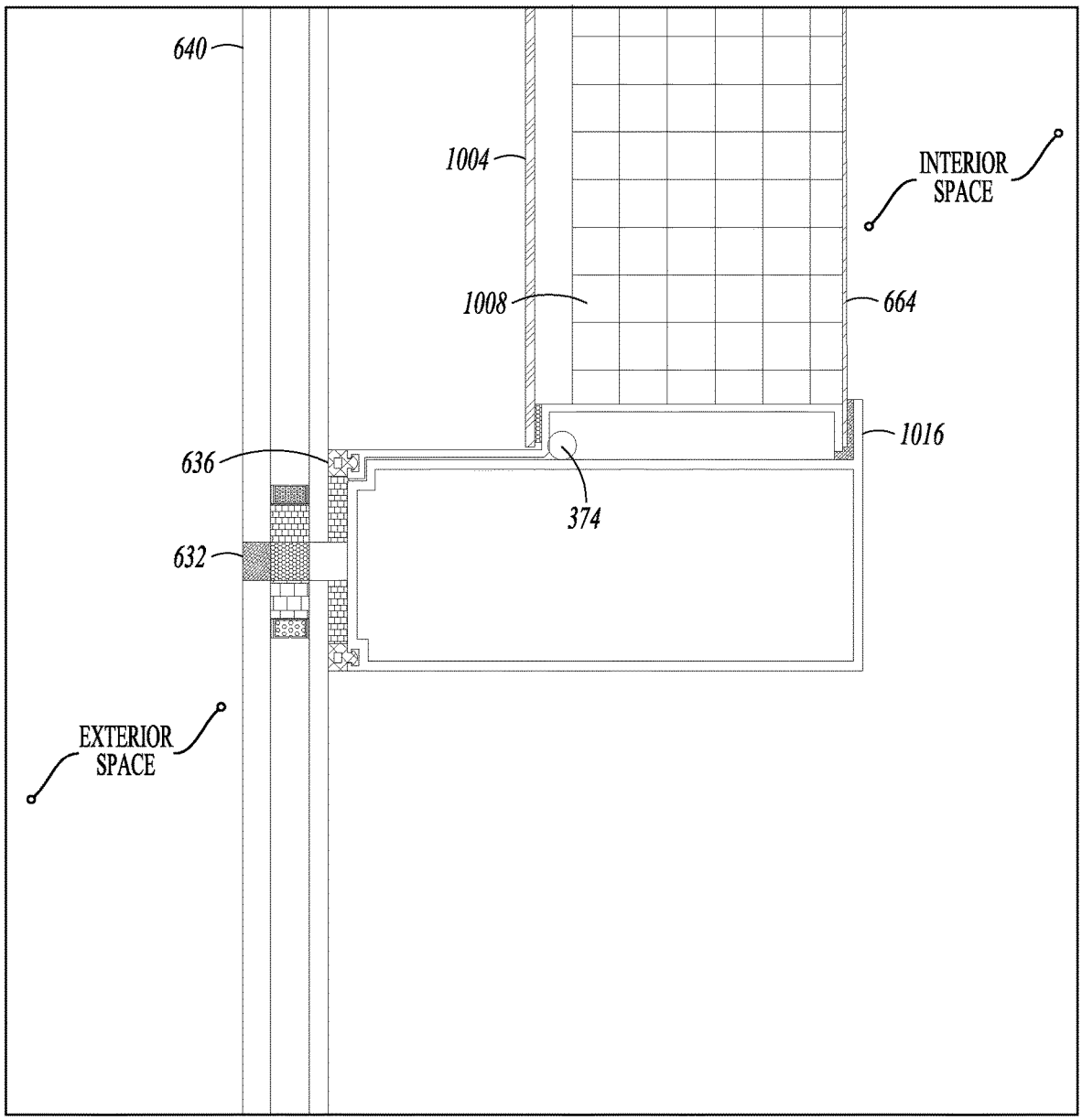

The horizontal section illustrated in FIG. 10B includes insulated glass 640, an aluminum shadowbox panel 1004, insulation 1008, hole 374 in the vertical mullion 308*b*, spacer gasket 636, silicone sealant 632, steel sheet 664, aluminum intermediate horizontal and 1016. The aluminum shadowbox panel 1004 may provide an opaque barrier, such as to hide a floor slab, perimeter structure, or other building element such as a mechanical or electrical system. The aluminum shadowbox panel 1004 may provide an opaque barrier, such as to hide a floor slab, perimeter structure, or other building element such as a mechanical or electrical system. The insulation 1008 may provide a thermal barrier, such as to reduce the heating or cooling requirements of the building. The galvanized steel sheet 664 may provide an air, water, and vapor barrier between the exterior and interior. A silicone bed gasket 636 and structural silicone 632 may provide a seal between the insulated glass 640 and the vertical mullions 308*a* and 308*b*. The hole 374 in the vertical mullion 308 may provide fluid communication between the protected horizontal chamber 652 and the protected vertical chamber 448.

Figures 1, 10C:
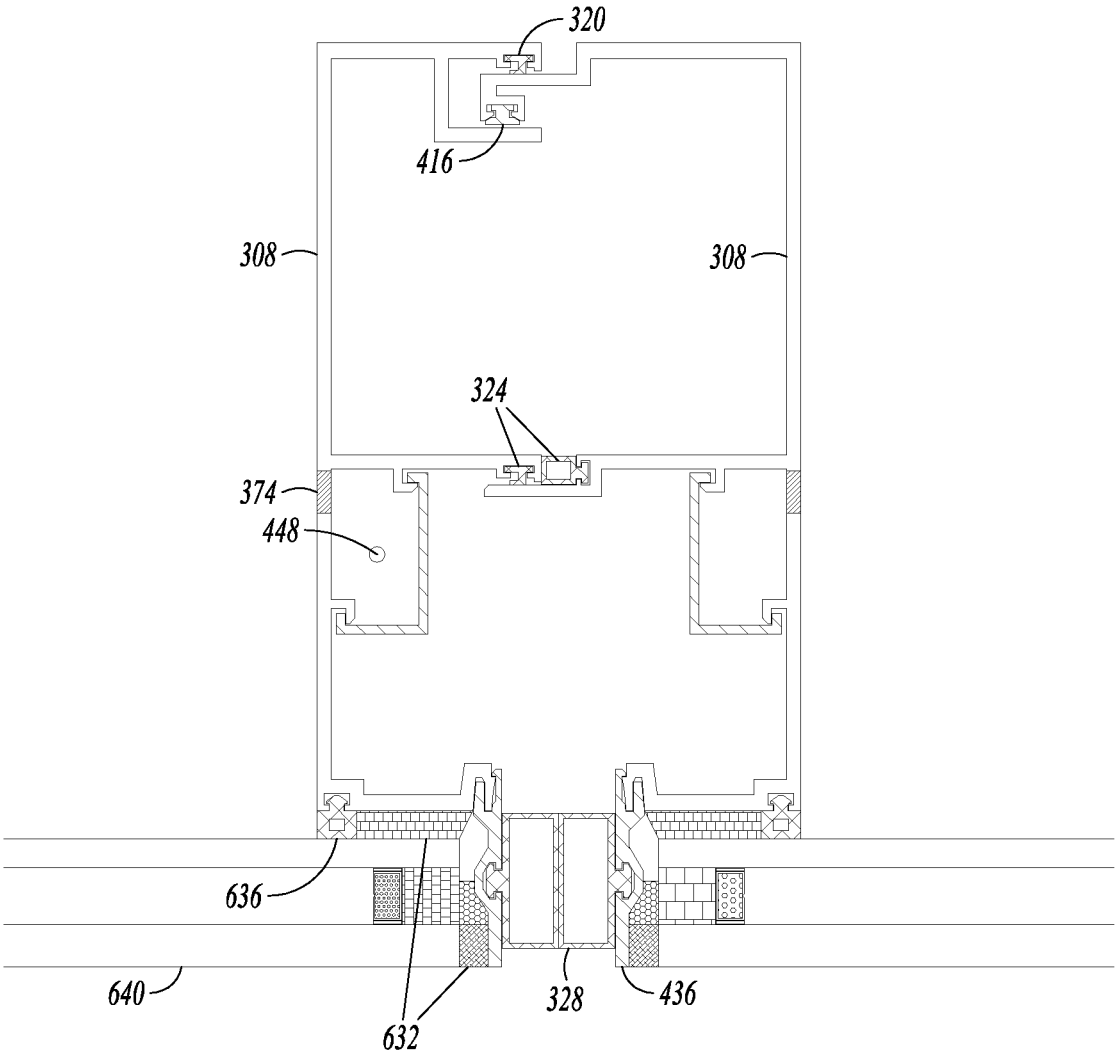

The vertical section illustrated in FIG. 10C-1 includes an air seal 320, a plastic isolator 416, a vertical mullion 308, a water seal 324, hole 374 in the vertical mullion 308, a protected vertical chamber 448, insulated glass 640, spacer gasket 636, silicone sealant 632, a plastic blade 436, and a rain screen gasket 328. In the example illustrated in FIG. 10C-1, the protected vertical chamber 448 may be formed with PVC components that may be separate from the vertical mullion 308. Each of the vertical mullions may include tabs configured to receive a PVC component. The PVC component may have an elastic property for insertion over the tabs and may have a shape memory to engage with the tabs to form an interior portion of the protected vertical chamber. The rain screen gasket 328 may allow for weeping of water and pressure equalization of interior cavities. The hole 374 in the vertical mullion 308 may provide fluid communication between the protected horizontal chamber 652 and the protected vertical chamber 448. A silicone bed gasket 636 and structural silicone 632 may provide a seal between the insulated glass 640 and the vertical mullions 308*a* and 308*b*.

Figures 2, 10C:
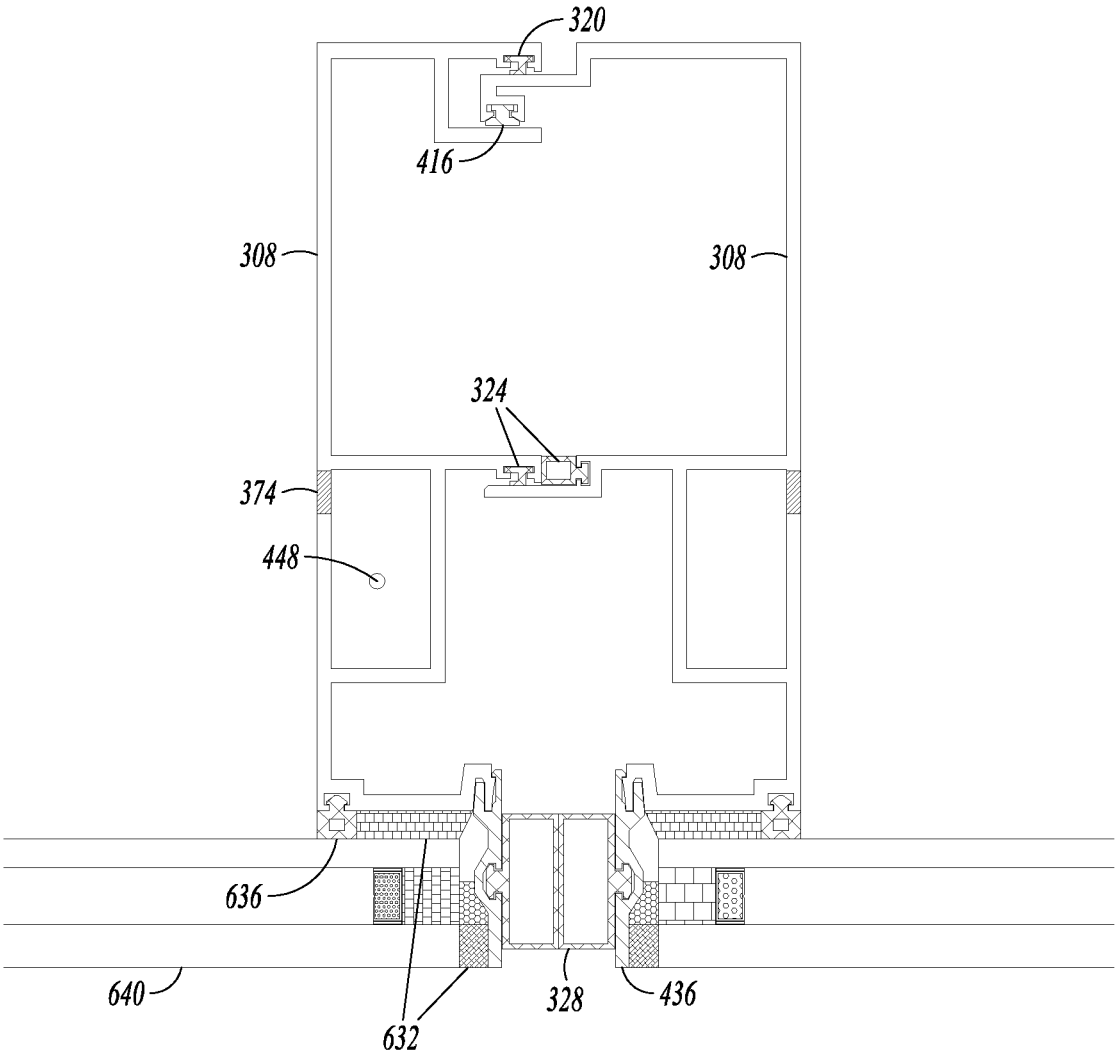

The vertical section illustrated in FIG. 10C-2 includes an air seal 320, a plastic isolator 416, a vertical mullion 308, a water seal 324, hole 374 in the vertical mullion 308, a protected vertical chamber 448, insulated glass 640, spacer gasket 636, silicone sealant 632, a plastic blade 436, and a rain screen gasket 328. In the example illustrated in FIG. 10C-2, the protected vertical chamber 448 may be formed by components (e.g., aluminum) that may be integrated with the vertical mullion 308. The rain screen gasket 328 may allow for weeping of water and pressure equalization of interior cavities. The hole 374 in the vertical mullion 308 may provide fluid communication between the protected horizontal chamber 652 and the protected vertical chamber 448. A silicone bed gasket 636 and structural silicone 632 may provide a seal between the insulated glass 640 and the vertical mullions 308*a* and 308*b*.

Figures 1, 10D:
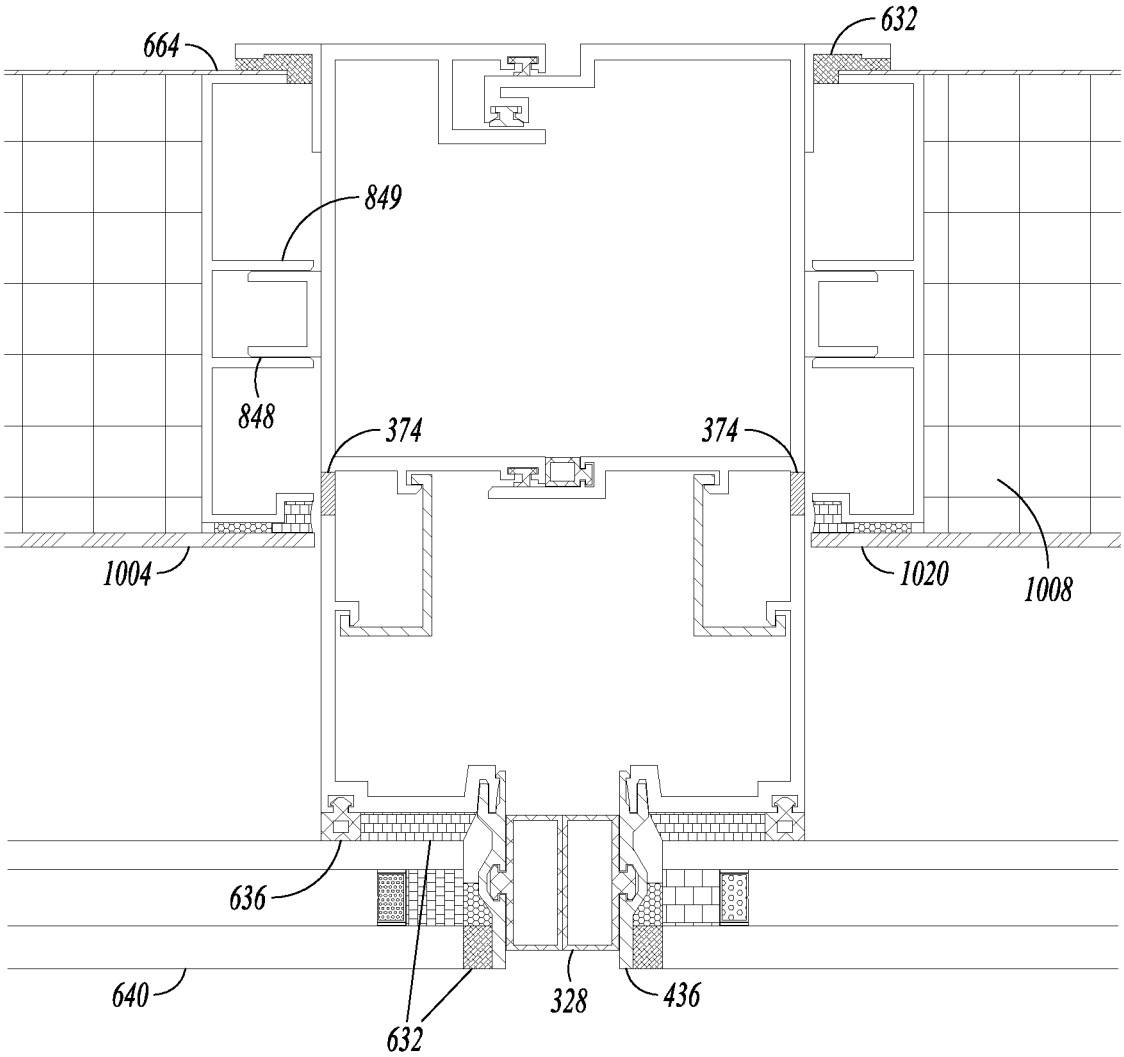
Figures 2, 10D:
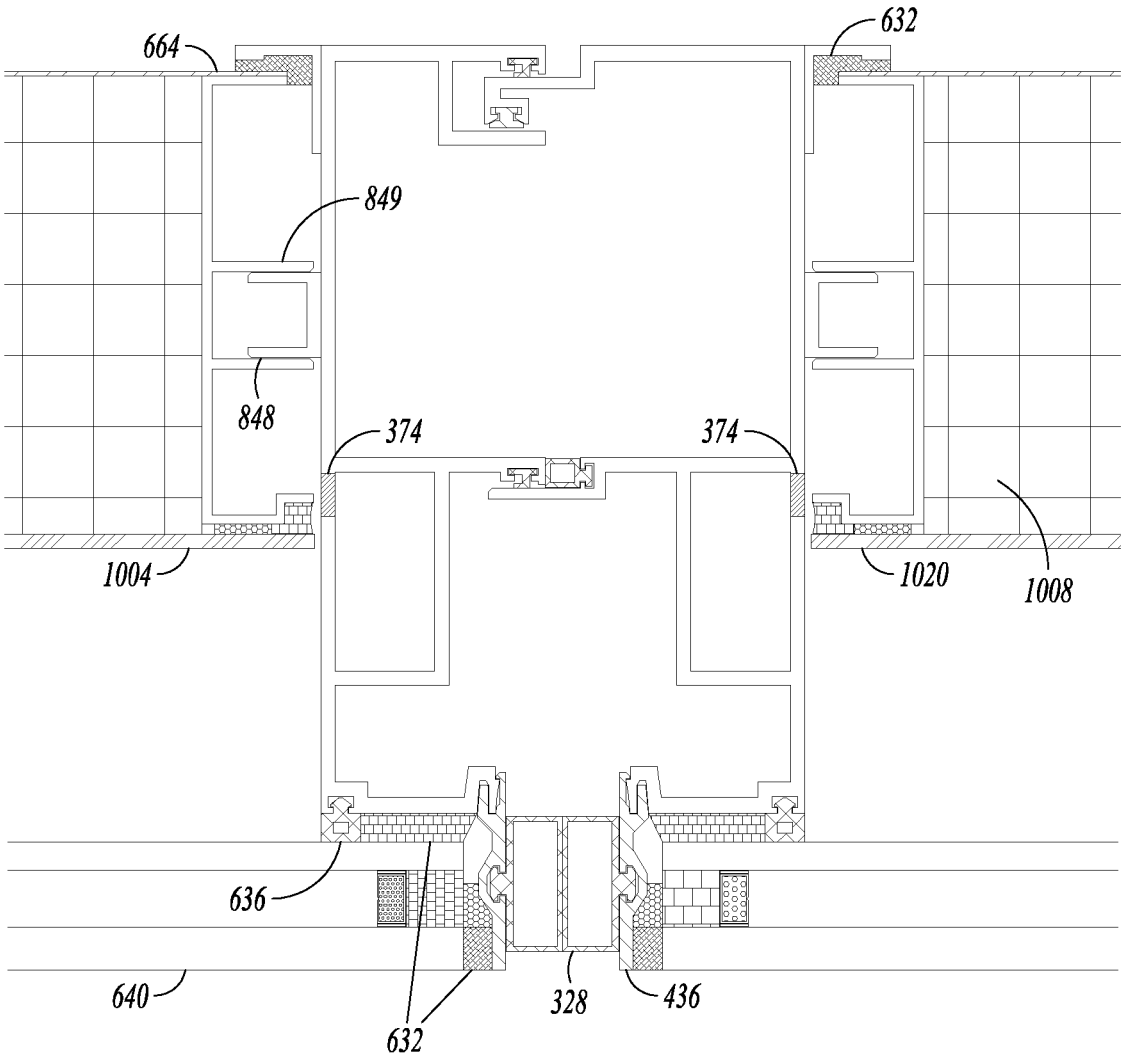

The vertical section illustrated in FIG. 10D-1 includes galvanized steel sheet 664, an aluminum shadowbox panel 1004, aluminum vertical channel 848, a floating channel 849, insulated glass 640, spacer gasket 636, silicone sealant 632, insulation 1008, a shadowbox frame 1020, plastic blade 436, and a rain screen gasket 328. The rain screen gasket 328 may allow for weeping of water and pressure equalization of interior cavities. The hole 374 in the vertical mullion 308 may provide fluid communication between the protected horizontal chamber 652 and the protected vertical chamber 448. A silicone bed gasket 636 and structural silicone 632 may provide a seal between the insulated glass 640 and the vertical mullions 308*a* and 308*b*. The aluminum shadowbox panel 1004 may provide an opaque barrier, such as to hide a floor slab, perimeter structure, or other building element such as a mechanical or electrical system. The insulation 1008 may provide a thermal barrier, such as to reduce the heating or cooling requirements of the building. The galvanized steel sheet 664 may provide an air, water, and vapor barrier between the exterior and interior. The aluminum vertical channel 848 in cooperation with the floating channel 849 may form a connection between the male vertical mullion 308*b* and the shadowbox assembly 804, such as to allow for thermal expansion and contraction at the connection while still maintaining the connection to the male vertical mullion 308*b*.

The vertical section illustrated in FIG. 10D-2 includes galvanized steel sheet 664, an aluminum shadowbox panel 1004, aluminum vertical channel 848, a floating channel 849, insulated glass 640, spacer gasket 636, silicone sealant 632, insulation 1008, a shadowbox frame 1020, plastic blade 436, and a rain screen gasket 328. The rain screen gasket 328 may allow for weeping of water and pressure equalization of interior cavities. The hole 374 in the vertical mullion 308 may provide fluid communication between the protected horizontal chamber 652 and the protected vertical chamber 448. A silicone bed gasket 636 and structural silicone 632 may provide a seal between the insulated glass 640 and the vertical mullions 308*a* and 308*b*. The aluminum shadowbox panel 1004 may provide an opaque barrier, such as to hide a floor slab, perimeter structure, or other building element such as a mechanical or electrical system. The insulation 1008 may provide a thermal barrier, such as to reduce the heating or cooling requirements of the building. The galvanized steel sheet 664 may provide an air, water, and vapor barrier between the exterior and interior. The aluminum vertical channel 848 in cooperation with the floating channel 849 may form a connection between the male vertical mullion 308*b* and the shadowbox assembly 804, such as to allow for thermal expansion and contraction at the connection while still maintaining the connection to the male vertical mullion 308*b*.

FIGS. 11A-11D illustrate a side sectional view of an assembly sequence for installing a shadowbox assembly into a curtainwall unit; and FIGS. 12A-12D illustrate a top sectional view of an assembly sequence for installing a shadowbox assembly into a curtainwall unit. Typically, the shadowbox is assembled in a factory and then the shadowbox assembly will be installed into the curtainwall unit in the factory. The completed curtainwall unit may be shipped to the construction site where it can be used to assemble the curtainwall system for use as the exterior cladding of the building.

Figure 11A:
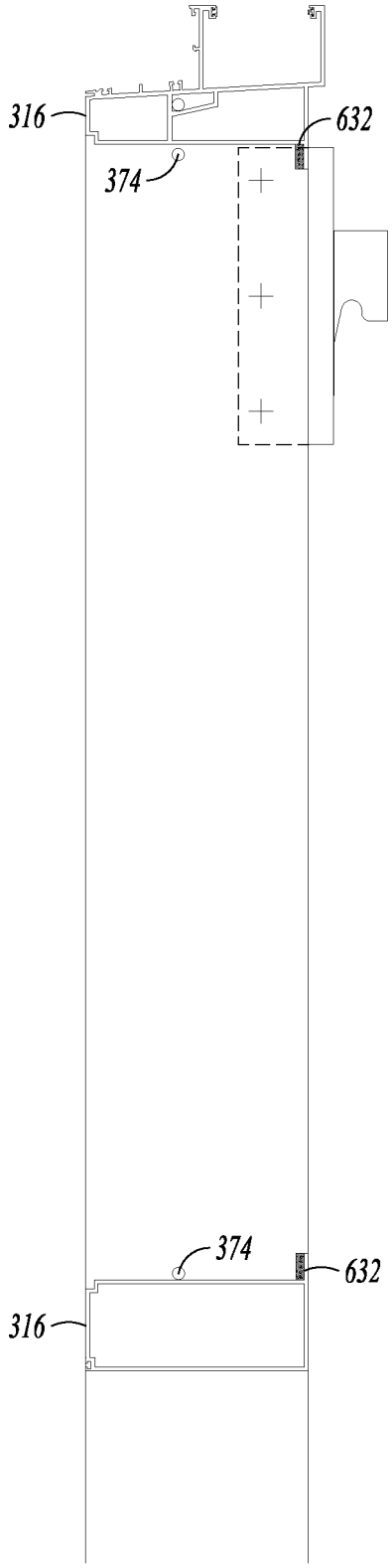
FIGS. 11A-11D illustrate a side sectional view of an example of an assembly sequence for installing a shadowbox assembly into a curtainwall unit.

The horizontal section illustrated in FIG. 11A includes a gutter 316, a hole 374 in the vertical mullion 308, and structural silicone 632. The gutter 316 may facilitate the drainage of fluid from an area between the air seal 320 and water seal 324 to the exterior in front of the installed curtainwall system. The hole 374 in the vertical mullion 308 may provide fluid communication between the protected horizontal chamber 652 and the protected vertical chamber 448. The structural silicone 632 may be applied to a perimeter of the curtainwall unit frame.

Figure 11B:
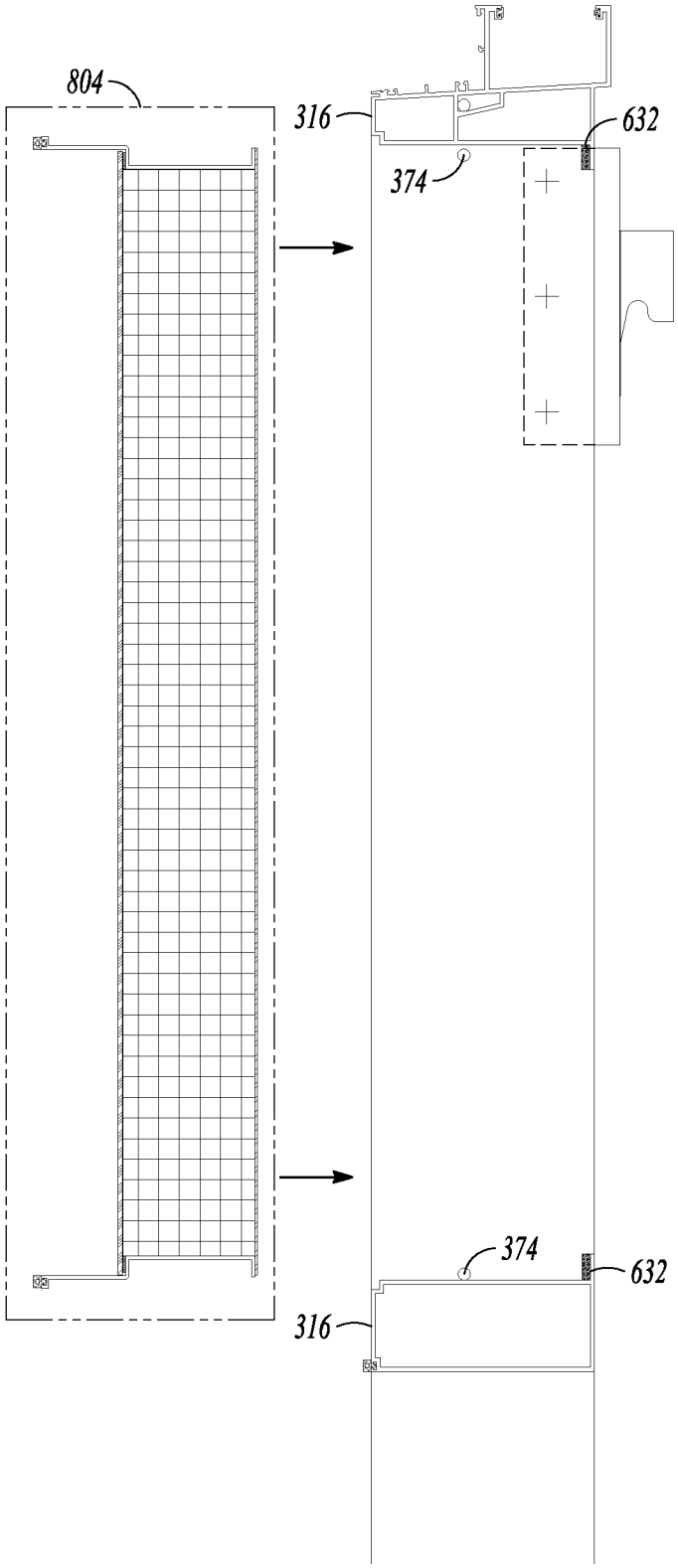

The horizontal section illustrated in FIG. 11B includes a gutter 316, a hole 374 in the vertical mullion 308, structural silicone 632, and a shadowbox assembly 804. The shadowbox assembly 804 may be inserted into the frame of the curtainwall unit and may contact the structural silicone applied to the perimeter of the curtainwall frame unit.

Figure 11C:
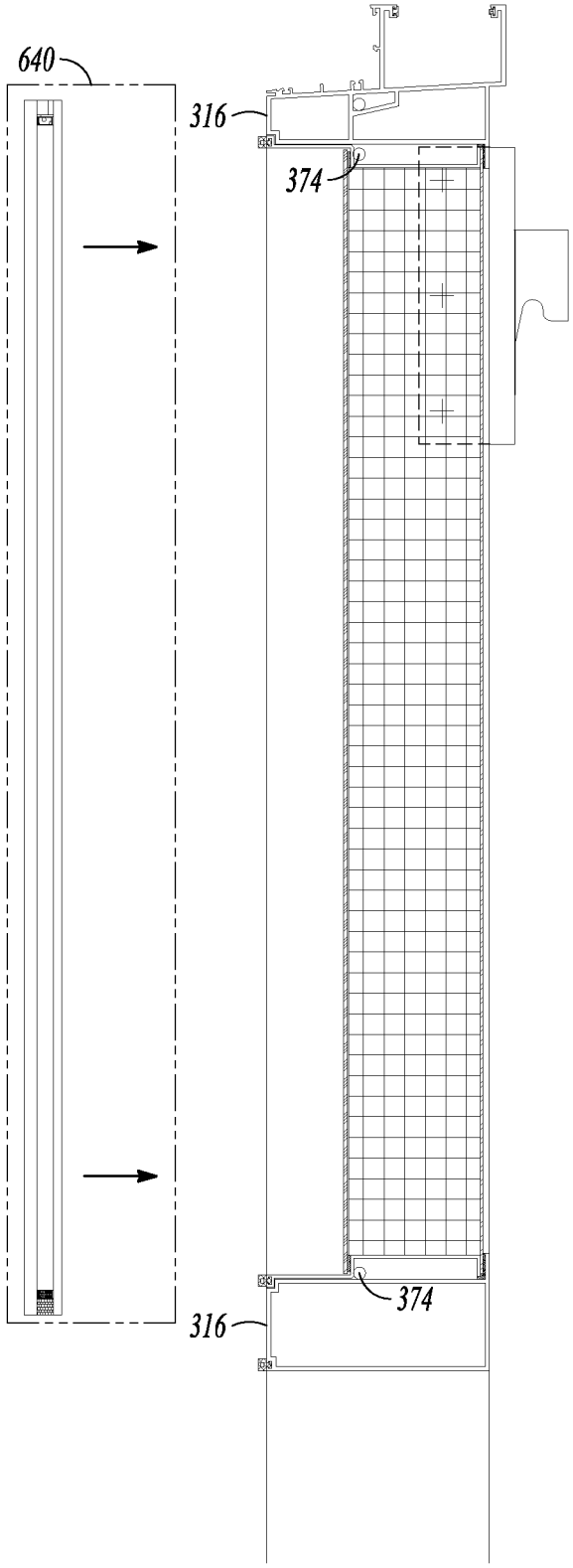
Figure 11D:
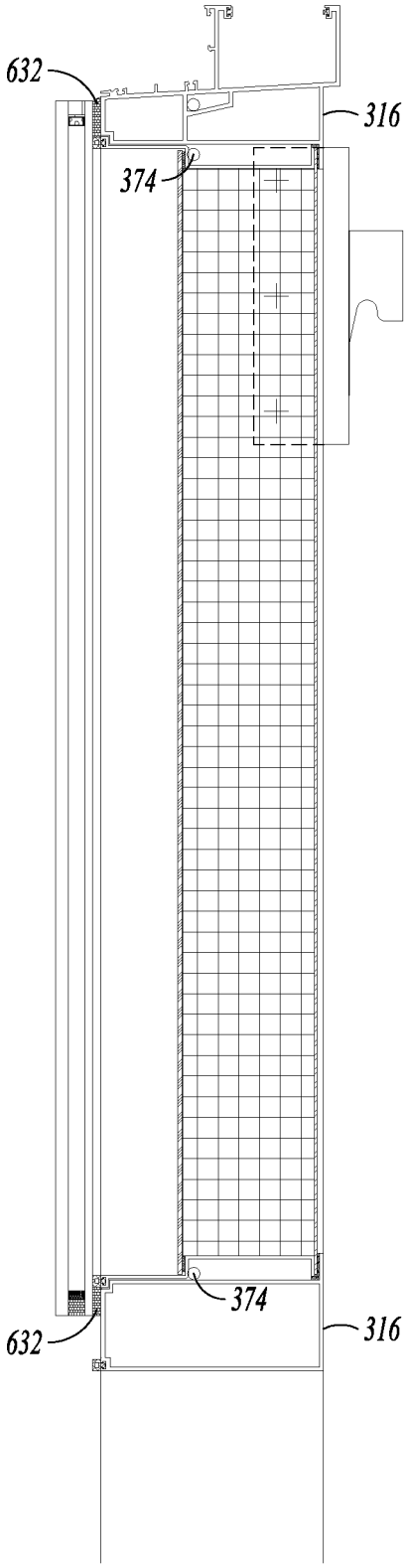

The horizontal section illustrated in FIG. 11C includes a gutter 316, a hole 374 in the vertical mullion 308, structural silicone 632, a shadowbox assembly 804, and insulated glass 640. The insulated glass 640 can be inserted into the frame of the curtainwall unit after the shadowbox assembly 804 is in place. Silicone sealant 632 can be applied along a boundary of the insulated glass 640 as illustrated in FIG. 11D.

Figure 12A:
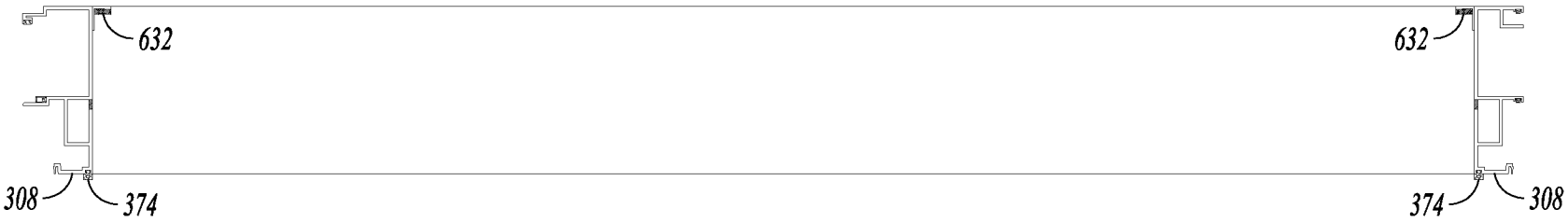
FIGS. 12A-12D illustrate a top sectional view of the assembly sequence illustrated in FIGS. 11A-11D.

The vertical section illustrated in FIG. 12A includes a hole 374 in the vertical mullion 308, and structural silicone 632. The hole 374 in the vertical mullion 308 may provide fluid communication between the protected horizontal chamber 652 and the protected vertical chamber 448. The structural silicone 632 may be applied to a perimeter of the curtainwall unit frame.

Figure 12B:
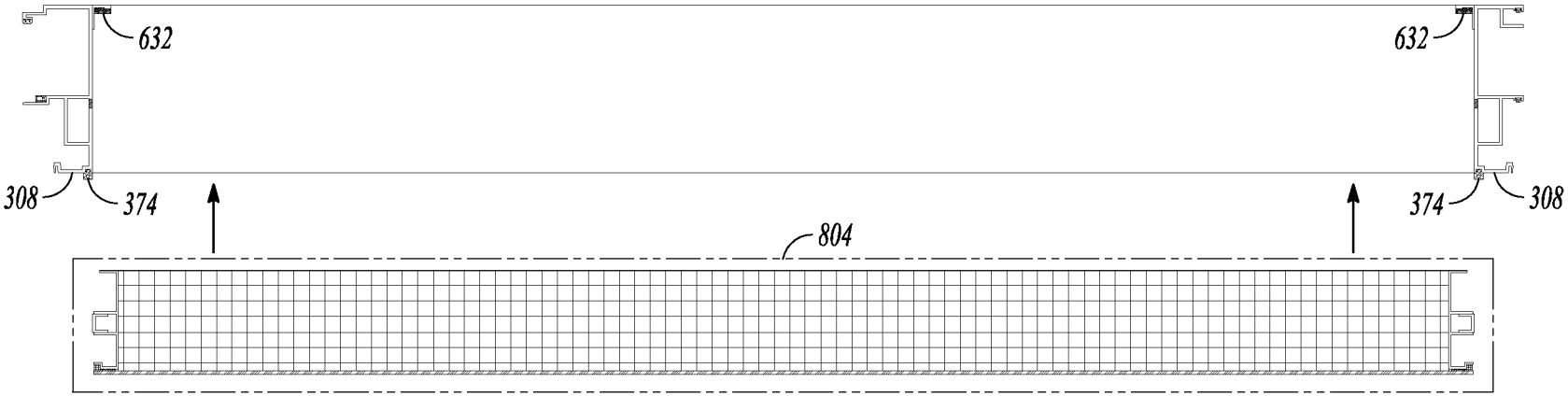

The vertical section illustrated in FIG. 12B includes a hole 374 in the vertical mullion 308, structural silicone 632, and a shadowbox assembly 804. The shadowbox assembly 804 may be inserted into the frame of the curtainwall unit and may contact the structural silicone applied to the perimeter of the curtainwall frame unit. The illustrated shadowbox assembly also illustrates that channels may be connected to the vertical mullions of the curtainwall unit, allowing the shadowbox assembly to be mechanically held in position while still allowing thermal expansion and contraction.

Figure 12C:
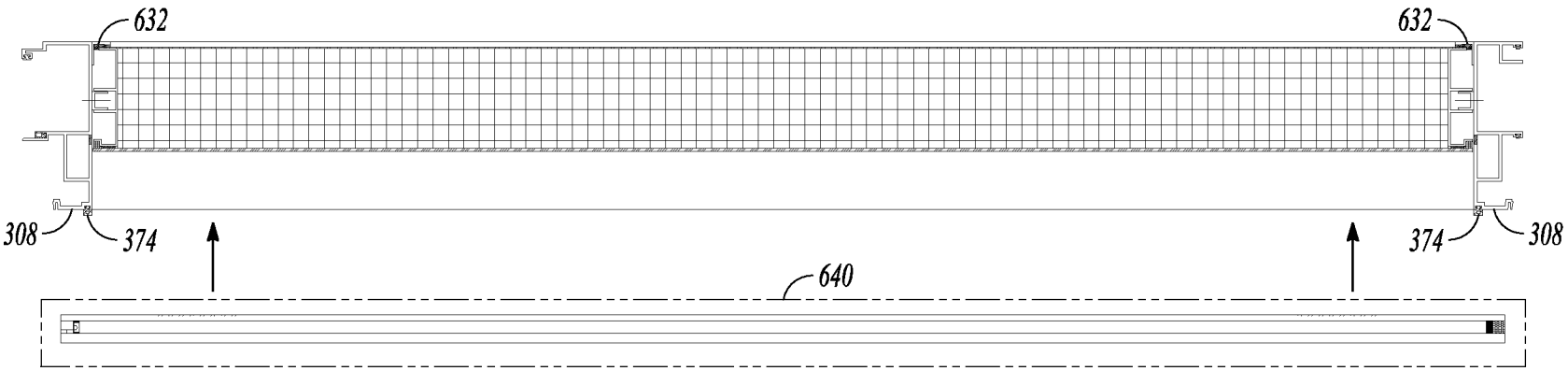
Figure 12D:
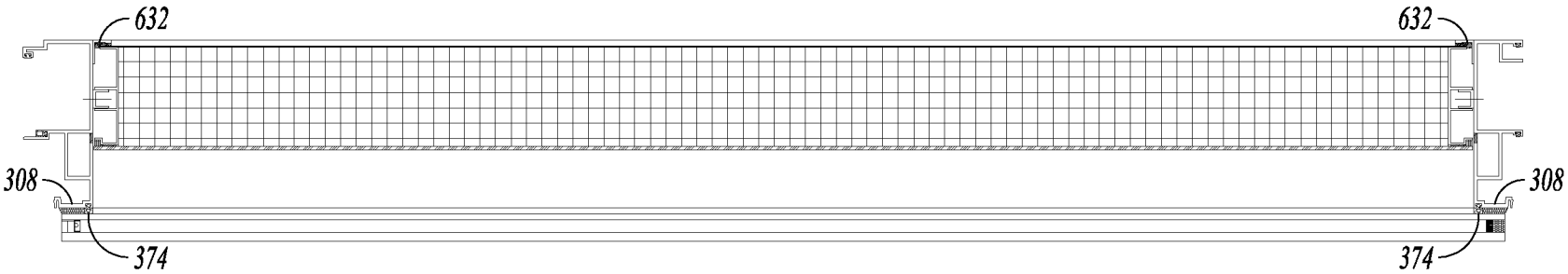

The vertical section illustrated in FIG. 12C includes a hole 374 in the vertical mullion 308, structural silicone 632, a shadowbox assembly 804, and insulated glass 640. The insulated glass 640 can be inserted into the frame of the curtainwall unit after the shadowbox assembly 804 is in place. Silicone sealant 632 can be applied along a boundary of the insulated glass 640 as illustrated in FIG. 12D.

The above detailed description is intended to be illustrative, and not restrictive. The scope of the disclosure should, therefore, be determined with references to the appended claims, along with the full scope of equivalents to which such claims are entitled.

What is claimed is:

1. A unitized curtainwall system, comprising:

an array of curtainwall units, each of the curtainwall units including a rainscreen gasket, water barrier gasket, and an air seal gasket and having a shape with sides configured to mate with sides of adjacent curtainwall units and form at least three gasket lines including a rainscreen gasket line, a water barrier gasket line and an air seal gasket line, each of the curtainwall units in the array including a horizontal gutter on a top side of the unit, the horizontal gutter including a rear channel between the water barrier gasket and the air seal gasket, and a horizontal drainage/equalization chamber at least partially beneath the rear channel, wherein the horizontal gutter defines a hole extending from the rear channel to the horizontal drainage/equalization chamber, thereby allowing water to drain from the rear channel of the horizontal gutter through the hole to the horizontal drainage/equalization chamber, wherein adjacent curtainwall units include vertical mullions that form a front cavity between the rainscreen gasket and the water barrier gasket and a rear cavity between the water barrier gasket and the air seal gasket, each of the vertical mullions including a vertical drainage/equalization chamber isolated from the front and rear cavities, wherein the vertical mullions define a hole that extends between the horizontal equalization drainage chamber to the vertical drainage/equalization chamber to allow water to drain from the horizontal drainage/equalization chamber through the hole into the vertical drainage/equalization chamber, and wherein a water barrier gasket beneath the curtainwall units extends across a joint between horizontally adjacent curtainwall units, the water barrier gasket to evacuate the water draining down the vertical drainage/equalization chamber out at a stack joint in the array of curtainwall units.

2. The unitized curtainwall system of claim 1, further comprising a waterproof silicone sponge gasket configured to fit within the horizontal gutter across the joint between the horizontally adjacent curtainwall units and at least one spring compression clip configured to press the silicone sponge gasket into position within the horizontal gutter to make a waterproof seal on each side of the joint.

3. The unitized curtainwall system of claim 1, further comprising a silicone putty plug in a hole where four joints between horizontally or adjacent curtainwall units join to maintain the air seal gasket line at a backside of the curtainwall system.

4. The unitized curtainwall system of claim 1, wherein each of the curtainwall units has a head horizontal mullion extending between the vertical mullions, a shadowbox assembly configured to be inserted into a space between the head horizontal mullion and the horizontal gutter, wherein the shadowbox assembly has a horizontal frame member with a forward lip configured to engage with a notch extending across a lower front portion of the horizontal gutter, and wherein a lower rear portion of the horizontal gutter has a reveal against which the shadowbox assembly engages when inserted into the curtainwall unit.

5. The unitized curtainwall system of claim 4, wherein a silicone bed gasket and structural silicone surround a periphery of the shadowbox assembly, and are sandwiched between insulated glass and the shadowbox assembly.

6. The unitized curtainwall system of claim 5, wherein the shadowbox assembly has a frame including a horizontal top frame member and a horizontal bottom frame member, wherein each of the horizontal top frame members and the horizontal bottom frame members have a horizontal channel that vents into the vertical drainage/equalization chamber.

7. A curtainwall unit, comprising:

a frame including a horizontal gutter, a horizontal sill, a first vertical mullion between a first end of the horizontal gutter and a first end of the horizontal sill, and a second vertical mullion between a second end of the horizontal gutter and a second end of the horizontal sill, wherein the horizontal gutter includes a rear channel extending across the horizontal gutter, and at least one protected horizontal channel at least partially beneath the rear channel, the horizontal gutter having at least one opening between the rear channel and the protected horizontal channel;

wherein each vertical mullion includes a protected vertical chamber and has at least one opening between the protected vertical chamber and the at least one protected horizontal channel; and wherein a periphery of the frame includes a rainscreen gasket, a water barrier gasket, and an air seal gasket such that, in conjunction with adjacent curtainwall units in an array of curtainwall units, the rainscreen gasket forms a rainscreen gasket line, the water barrier gasket forms a water barrier gasket line, and the air seal gasket forms an air seal gasket line, wherein the water barrier gasket is between the rainscreen gasket and the air seal gasket, and the rear channel is between the air seal gasket and the water barrier gasket, the air seal gasket being configured to cooperate with horizontal sill of a vertically adjacent curtainwall unit to form an air seal gasket line.

8. The curtainwall unit of claim 7, wherein each of the vertical mullions is integrally formed with the protected vertical chamber.

9. A curtainwall unit, comprising:

a frame including a horizontal gutter, a horizontal sill, a first vertical mullion between a first end of the horizontal gutter and a first end of the horizontal sill, and a second vertical mullion between a second end of the horizontal gutter and a second end of the horizontal sill, wherein the horizontal gutter includes a rear channel extending across the horizontal gutter, and at least one protected horizontal channel at least partially beneath the rear channel, the horizontal gutter having at least one opening between the rear channel and the at least one protected horizontal channel;

wherein each vertical mullion includes a protected vertical chamber and has at least one opening between the protected vertical chamber and the at least one protected horizontal channel; and wherein each of the vertical mullions includes tabs configured to receive a PVC component, wherein the PVC component has an elastic property for insertion over the tabs and has a shape memory to engage with the tabs to form an interior portion of the protected vertical chamber.

10. The curtainwall unit of claim 9, wherein the frame further includes a head horizontal mullion extending between the vertical mullions, the curtainwall unit further comprising a shadowbox assembly between the head horizontal mullion and the horizontal gutter.

11. A curtainwall unit, comprising:

a frame including a horizontal gutter, a horizontal sill, a first vertical mullion between a first end of the horizontal gutter and a first end of the horizontal sill, and a second vertical mullion between a second end of the horizontal gutter and a second end of the horizontal sill, wherein the horizontal gutter includes a rear channel extending across the horizontal gutter, and at least one protected horizontal channel at least partially beneath the rear channel, the horizontal gutter having at least one opening between the rear channel and the at least one protected horizontal channel;

wherein each vertical mullion includes a protected vertical chamber, the vertical mullion having at least one opening between the protected vertical chamber and the at least one protected horizontal channel;

wherein the frame further includes a head horizontal mullion extending between the vertical mullions, the curtainwall unit further comprising a shadowbox assembly between the head horizontal mullion and the horizontal gutter; and wherein the horizontal gutter has a lower front portion and a lower rear portion, wherein the lower rear portion forms a reveal against which the shadowbox assembly engages, the lower front portion has a notch, and the shadowbox assembly has a horizontal frame member with a forward lip configured to engage with the notch.

12. The curtainwall unit of claim 11, wherein a silicone bed gasket and structural silicone surround a periphery of the shadowbox assembly, and are sandwiched between insulated glass and the shadowbox assembly.

13. The curtainwall unit of claim 11, wherein the shadowbox assembly has a frame including a horizontal top frame member and a horizontal bottom frame member, wherein each of the horizontal top frame member and the horizontal bottom frame member has a horizontal channel that vents into the protected vertical chamber through a hole located in the vertical mullion.

14. A method for assembling a curtainwall unit, comprising:

assembling a frame including a horizontal gutter, a horizontal sill, a first vertical mullion between a first end of the horizontal gutter and a second end of the horizontal sill, a second vertical mullion between a second end of the horizontal gutter and a second end of the horizontal sill, and a head horizontal mullion extending between the first and second vertical mullions, wherein the horizontal gutter, the head horizontal mullion, and both vertical mullions have a reveal parallel to a back surface of the frame and extending inwardly toward a space defined by the horizontal gutter, the head horizontal mullion, and both vertical mullions, and wherein the horizontal gutter has a lower front notch and the head horizontal mullion has an upper front notch;

inserting a shadowbox assembly into the space defined by the horizontal gutter, the head horizontal mullion, and both vertical mullions, the shadowbox assembly having a top frame member with a front lip and a bottom frame member with a front lip, wherein inserting the shadowbox assembly incudes inserting the shadowbox assembly until a rear of the shadowbox assembly contacts the reveals and the front lip of the top frame member contacts the notch in the horizontal gutter, and the front lip of the bottom frame member contacts the notch in the head horizontal mullion.

15. The method of claim 14, further comprising:

placing a silicone bed gasket and structural silicone around a front periphery of the shadowbox assembly, and installing insulated glass onto the frame, thereby holding the shadowbox assembly in place.

16. The method of claim 14, further comprising using structural components to restrict movement of the shadowbox assembly perpendicular to a glass plane on a front of the shadowbox assembly, while allowing shadowbox assembly to float to allow for thermal expansion and contraction of an aluminum panel within the shadowbox assembly.

17. A method for installing a unitized curtainwall system, comprising:

installing adjacent curtainwall units, thereby forming a joint between the adjacent curtainwall units, wherein each curtainwall unit has a horizontal mullion that forms a rear gutter between a water barrier gasket line and an air seal gasket line; and placing a waterproof silicone sponge gasket into the rear gutter across the joint, and securing the waterproof silicone sponge gasket within the rear gutter using at least one spring clip to press the silicone sponge gasket into position within the rear gutter to make a waterproof seal on each side of the joint.

18. The method of claim 17, further comprising plugging a joint between four curtainwall units with a silicone putty plug.

19. The method of claim 17, further comprising attaching a PVC component having an elastic property to each of a first and second vertical mullion to form respective first and second vertical cavities.

20. The method of claim 17, further comprising placing a water barrier gasket on top of and spanning the joint between the adjacent curtainwall units.

21. A method for installing a unitized curtainwall system, comprising:

installing adjacent curtainwall units in a first row, thereby forming a joint between the adjacent curtainwall units in the first row;

placing a water barrier gasket on top of the first row such that the water barrier gasket spans the joint; and installing adjacent curtain wall units in a second row on top of the first row, thereby forming a joint between the adjacent curtainwall units in the second row that is aligned with the joint between the adjacent curtainwall units in the first row, wherein each curtainwall unit has a horizontal mullion that forms a rear gutter between a water barrier gasket line and an air seal gasket line, and wherein the water barrier gasket is positioned at the water harrier gasket line, the method further comprising placing a waterproof silicone sponge gasket into the rear gutter across the joint, and securing the waterproof silicone sponge gasket within the rear gutter using at least one spring clip to press the silicone sponge gasket into position within the rear gutter to make a waterproof seal on each side of the joint.

22. A curtainwall system to provide exterior cladding for a building, the curtainwall system comprising:

a plurality of curtainwall units, each of the plurality of curtain wall units including a frame comprising a horizontal gutter as a top framing member, a horizontal sill as a bottom framing member, and vertical mullions as the side framing member;

three gasket lines between adjacent curtain wall units, the three gasket lines including a rain screen gasket line, an air seal gasket line, and a water seal gasket line;

a horizontal gutter configured with a rear channel behind the water seal gasket line;

a protected horizontal chamber at least partially beneath the rear channel and spanning across the water seal gasket line; and the vertical mullion being configured with a protected vertical chamber in front of the water seal gasket line, wherein the curtainwall system is configured to provide, for each of the plurality of curtain wall units, a drainage and ventilation path from the rear channel between the air seal gasket line and the water seal gasket line, through the protected horizontal chamber and the protected vertical chamber, and out through the rain screen gasket line beneath the horizontal sill.

23. The curtainwall system of claim 22 further comprising a gasket at a joint between horizontally adjacent rear channels of adjacent curtainwall units.

24. The curtainwall system of claim 23 further comprising a clip at the joint between the horizontally adjacent rear channels of adjacent curtainwall units, wherein the gasket includes a sponge gasket.

25. The curtainwall system of claim 22 further comprising a silicone plug to maintain an air seal gasket line between four adjacent curtainwall units.

26. The curtainwall system of claim 22 wherein the water seal gasket line includes a water seal gasket extending beneath the protected vertical chamber.

27. A curtainwall unit, comprising:

a frame including a horizontal gutter, a horizontal sill, a first vertical mullion between a first end of the horizontal gutter and a first end of the horizontal sill, and a second vertical mullion between a second end of the horizontal gutter and a second end of the horizontal sill, wherein the horizontal gutter includes a rear channel extending across the horizontal gutter, and at least one protected horizontal channel at least partially beneath the rear channel, the horizontal gutter having at least one opening between the rear channel and the at least one protected horizontal channel;

wherein each vertical mullion includes a protected vertical chamber and has at least one opening between the protected vertical chamber and the at least one protected horizontal channel;

wherein a periphery of the frame includes a rainscreen gasket, a water barrier gasket, and an air seal gasket such that, in conjunction with adjacent curtainwall units in an array of curtainwall units, the rainscreen gasket forms a rainscreen gasket line, the water barrier gasket forms a water barrier gasket line, and the air seal gasket forms an air seal gasket line, wherein the water barrier gasket is between the rainscreen gasket and the air seal gasket, and the rear channel is between the air seal gasket and the water barrier gasket, the air seal gasket being configured to cooperate with horizontal sill of a vertically adjacent curtainwall unit to form an air seal gasket line; and wherein each of the vertical mullions includes tabs configured to receive a PVC component, wherein the PVC component has an elastic property for insertion over the tabs and has a shape memory to engage with the tabs to form an interior portion of the protected vertical chamber.

28. The curtainwall unit of claim 27, wherein each of the vertical mullions is integrally formed with the protected vertical chamber.

29. The curtainwall unit of claim 27, wherein the frame further includes a head horizontal mullion extending between the vertical mullions, the curtainwall unit further comprising a shadowbox assembly between the head horizontal mullion and the horizontal gutter.

30. A curtainwall system to provide exterior cladding for a building, the curtain wall system comprising:

a plurality of curtainwall units, each of the plurality of curtainwall units including a frame comprising a horizontal gutter as a top framing member, a horizontal sill as a bottom framing member, and vertical mullions as a side framing member;

three gasket lines between adjacent curtainwall units, the three gasket lines including a rain screen gasket line, an air seal gasket line, and a water seal gasket line;

the horizontal gutter being configured with a rear channel behind the water seal gasket line;

a protected horizontal chamber at least partially beneath the rear channel and spanning across the water seal gasket line;

each of the vertical mullions being configured with a protected vertical chamber in front of the water seal gasket line, wherein the curtainwall system is configured to provide, for each of the plurality of curtainwall units, a drainage and ventilation path from the rear channel between the air seal gasket line and the water seal gasket line, through the protected horizontal chamber and the protected vertical chamber; and out through the rain screen gasket line beneath the horizontal sill; and the curtainwall system further comprising a gasket at a joint between horizontally adjacent rear channels of adjacent curtainwall units, a clip at the joint between the horizontally adjacent rear channels of adjacent curtainwall units, wherein the gasket includes a sponge gasket, and a silicone plug to maintain the air seal gasket line between four adjacent curtainwall units, wherein the water seal gasket line includes a water seal gasket extending beneath the protected vertical chamber.

* * * * *